US005538836A

United States Patent [19]

Ueda et al.

[11] Patent Number: 5,538,836

[45] Date of Patent: Jul. 23, 1996

[54] SILVER HALIDE COLOR PHOTOGRAPHIC MATERIAL

[75] Inventors: Fumitaka Ueda; Junji Nishigaki; Tetsuo Nakamura, all of Kanagawa, Japan

[73] Assignee: Fuji Photo Film Co., Ltd., Kanagawa, Japan

[21] Appl. No.: 559,251

[22] Filed: Nov. 15, 1995

Related U.S. Application Data

[63] Continuation of Ser. No. 281,096, Jul. 27, 1994, abandoned.

[30] Foreign Application Priority Data

Jul. 27, 1993 [JP] Japan ..... 5-185134

[51] Int. Cl.[6] ..... G03C 1/46; G03C 1/16

[52] U.S. Cl. ..... 430/505; 430/362; 430/504; 430/510; 430/513; 430/517; 430/572; 430/577; 430/583; 430/588; 430/522

[58] Field of Search ..... 430/505, 572, 430/504, 510, 513, 517, 588, 583, 577, 522, 362

[56] References Cited

U.S. PATENT DOCUMENTS 4,705,744 11/1987 Sasaki et al. ..... 430/362
5,296,344 3/1994 Jimbo et al. ..... 430/522

*Primary Examiner*—Thorl Chea
*Attorney, Agent, or Firm*—Sughrue, Mion, Zinn, Macpeak & Seas

[57] ABSTRACT

A silver halide color photographic material having an excellent color reproducibility, high sensitivity and excellent graininess.

The silver halide color photographic material contains at least one of each blue-sensitive emulsion, green-sensitive emulsion, red-sensitive emulsion layer and hydrophilic colloid layers, in which the hydrophilic colloid layer contains a compound of formula (I) and the silver halide emulsion layer, which gives an interlayer effect to said red-sensitive layer, contains a silver halide emulsion spectrally sensitized with a compound represented by formulae (II) and (III).

(I)

(II)

(III)

10 Claims, No Drawings

SILVER HALIDE COLOR PHOTOGRAPHIC MATERIAL

This is a Continuation of Application Ser. No. 08/281,096 filed Jul. 27, 1994, now abandoned.

FIELD OF THE INVENTION

The present invention relates to a silver halide color photographic material and, in particular, to a high-sensitive silver halide color photographic material having good color reproducibility and graininess.

BACKGROUND OF THE INVENTION

Hitherto, it has been known to utilize an interlayer development-inhibiting effect (hereinafter referred to as interlayer effect) as a means for improving the color reproducibility of color photographic materials.

Referring to an example of a color negative photographic material, impartation of a development inhibiting effect from the green-sensitive layer to the red-sensitive layer makes a color forming of the red-sensitive layer by white light exposure is suppressed lower than that by red light exposure. Similarly, the development inhibiting effect of the red-sensitive layer on the green-sensitive layer in the color photographic material gives thereto green reproduction in a higher saturation degree.

Where the saturation (chroma) of the principle colors i.e., red, green and blue colors, is elevated by the method, there occurs a drawback that the yellowish to cyanic green color hue could not be reproduced faithfully. Given the situation, JP-A-61-34541 (the term "JP-A" as used herein means an "unexamined published Japanese patent application") has proposed a technique of overcoming the drawback. Precisely, this has proposed a silver halide color photographic material having at least one blue-sensitive silver halide emulsion layer containing yellow color-forming coupler(s), at least one green-sensitive silver halide emulsion layer containing magenta color-forming coupler(s) and at least one red-sensitive silver halide emulsion layer containing cyan color-forming coupler(s) on a support, in which the weight-average wavelength in the color sensitivity distribution of said green-sensitive layer (weight-average $\lambda G$) falls between 520 nm and 580 nm (520 nm$\leqq$(weight-average $\lambda_G$)$\leqq$580 nm), the weight-average wavelength in the distribution of the interlayer effect of the layers on at least one red-sensitive silver halide emulsion layer (weight-average $\lambda\text{-}_R$) within a wavelength range between 500 nm and 600 nm is such that 500 nm<(weight average $\lambda\text{-}_R$)$\leqq$600 nm and (weight-average $\lambda_G$)−(weight average $\lambda\text{-}_R$)$\geqq$5 nm. The photographic material has been proposed to attain faithful color reproduction.

However, evaluation of the color prints obtained by using the proposed photographic material has revealed that the graininess of the silver halide emulsion layer that gives the interlayer effect to the red-sensitive layer is worse than that of the other coloring layers.

This is considered because the absorption of the conventional sensitizing dyes used in the layer having the interlayer effect is weak and the yellow filter layer cuts a light near 500 nm to an extent more than required.

SUMMARY OF THE INVENTION

An object of the present invention is to overcome the above-mentioned problem and to provide a color photographic material having good color reproducibility and graininess.

The object of the present invention is attained by a silver halide color photographic material comprising at least one of each blue-sensitive silver halide emulsion layer, green-sensitive silver halide emulsion layer, red-sensitive silver halide emulsion layer and hydrophilic colloid layer on a support, in which said hydrophilic colloid layer contains a compound of the following formula (I), and the silver halide emulsion layer, which gives an interlayer effect to said red-sensitive layer contains a silver halide emulsion spectrally sensitized with at least one of each compounds represented by formulae (II) and (III).

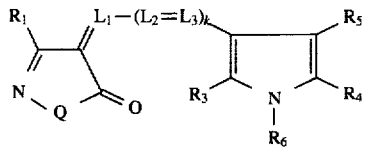

(I)

wherein $R_1$ represents a hydrogen atom, an alkyl group, an alkenyl group, an aryl group, a heterocyclic group, an ureido group, a sulfonamido group, a sulfamoyl group, a sulfonyl group, a sulfinyl group, an alkylthio group, an arylthio group, an oxycarbonyl group, an acyl group, a carbamoyl group, a cyano group, an alkoxy group, an aryloxy group, an amino group or an amido group;

Q represents —O— or —$NR_2$— in which $R_2$ represents a hydrogen atom, an alkyl group, an aryl group or a heterocyclic group;

$R_3$, $R_4$ and $R_5$ each represents a hydrogen atom, an alkyl group or an aryl group, and $R_4$ and $R_5$ may together form a 6-membered ring;

$R_6$ represents a hydrogen atom, an alkyl group, an aryl group or an amino group;

$L_1$, $L_2$ and $L_3$ each represents a methine group; and k represents 0 or 1.

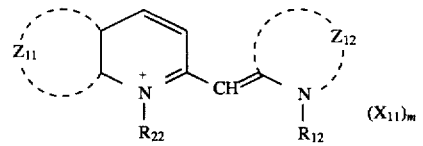

(II)

wherein $R_{11}$ and R12 each represents an alkyl group;

$Z_{11}$ represents an atomic group necessary for forming a benzene ring;

$Z_{12}$ represents an atomic group necessary for forming a benzothiazole nucleus or benzoselenazole nucleus;

$X_{11}$ represents a charge-balancing counter ion; and m represents 0 or 1, but m is 0 when the formula forms an internal salt.

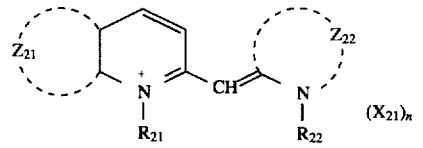

(III)

wherein $R_{21}$, $R_{22}$, $Z_{21}$, $X_{21}$ and n have the same meanings as $R_{11}$, $R_{12}$, $Z_{11}$, $X_{11}$ and m, respectively, in formula (II); and $Z_{22}$ represents an atomic group necessary for forming a benzoxazole nucleus or naphthoxazole nucleus.

As one preferred embodiment of the silver halide color photographic material of the present invention, the layer giving the interlayer effect to the red-sensitive layer in the material contains a silver halide emulsion spectrally sensitized with at least one of each compounds of the following general formula (IV) and (V).

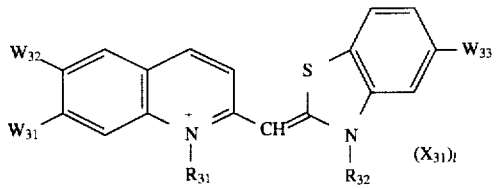

(IV)

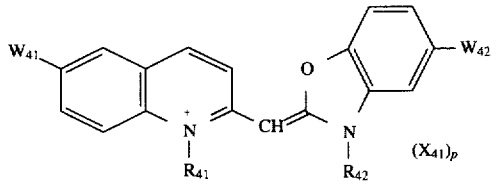

(V)

wherein $R_{31}$, $R_{32}$, $R_{41}$ and $R_{42}$ each represent a sulfoalkyl group or a carboxyalkyl group;

$X_{31}$ and $X_{41}$ each have the same meaning as $X_{11}$ in formula (II);

l and p each have the same meaning as m in formula (II);

$W_{31}$, $W_{32}$ and $W_{41}$ each represent an alkyl group having 3 or less carbon atoms, a halogen atom, an aryl group or an aryloxy group; and $W_{33}$ and $W_{42}$ each represent a halogen atom or an aryl group.

As another preferred embodiment of the photographic material of the present invention, tabular grains having an aspect ratio of 2 or more account for 40% or more of the total projected area of all the silver halide grains contained in the layer giving the interlayer effect to the red-sensitive layer in the material.

DETAILED DESCRIPTION OF THE INVENTION

As the first characteristic feature, the color photographic material of the present invention having at least one blue-sensitive silver halide emulsion layer, at least one green-sensitive silver halide emulsion layer and at least one red-sensitive silver halide emulsion layer on a support has a hydrophilic colloid layer containing a compound of formula (I):

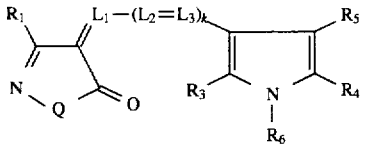

(I)

wherein $R_1$ represents a hydrogen atom, an alkyl group having 1 to 30, preferably 1 to 20 carbon atoms, an alkenyl group having 1 to 30, preferably 1 to 20 carbon atoms, an aryl group having 6 to 30, preferably 6 to 20 carbon atoms, a heterocyclic group, an ureido group, a sulfonamido group, a sulfamoyl group, a sulfonyl group, a sulfinyl group, an alkylthio group, an arylthio group, an oxycarbonyl group, an acyl group, a carbamoyl group, a cyano group, an alkoxy group, an aryloxy group, an amino group or an amido group;

Q represents —O— or —$NR_2$— in which $R_2$ represents a hydrogen atom, an alkyl group, an aryl group or a heterocyclic group;

$R_3$ and $R_4$ each represents a hydrogen atom, an alkyl group having 1 to 10, preferably 1 to 4 carbon atoms or an aryl group having 6 to 10 carbon atom; $R^5$ represents a hydrogen atom, an alkyl group having 0 to 30, preferably 1 to 10 carbon atoms, an aryl group having 6 to 30, preferably 6 to 10 carbon atoms; and $R_4$ and $R_5$ may together form a 6-membered ring;

$R_6$ represents a hydrogen atom, an alkyl group having 1 to 10, preferably 1 to 4 carbon atoms, an aryl group having 6 to 10 carbon atoms or an amino group;

$L_1$, $L_2$ and $L_3$ each represents a methine group; and k is 0 or 1.

Where the compound is used as a filter dye, any effective amount thereof may be used but it is preferred to use thereof in such a way that an optical density may fall within the range of from 0.05 to 3.0, preferably from 0.2 to 1.0. The amount of the compound to be used falls within the range of from 1 to 1000 mg per $m^2$ of the photographic material.

Where it is used as others than filter dyes, the compound may also be used in any effective amount. Regarding the specific amount of the compound to be used in such a case, the same range as mentioned above may apply thereto.

The dye of the present invention may be dispersed in the emulsion layers and other hydrophilic colloid layers such as interlayer, protective layer, anti-halation layer, filter layer, etc by various known methods For example, the methods described in JP-A-3-173383 may be employed.

The dye of the present invention may be dispersed in the emulsion layers and other hydrophilic colloid layers, but it is preferably dispersed in the layers positioned further from the support than the green-sensitive silver halide emulsion layers. For instance, in the photographic material having an yellow filter layer, the dye is especially preferably dispersed in the yellow filter layer. This is because the light absorption of the dye of the present invention for a particular wavelength range is sharper than that of yellow colloidal silver. Therefore, incorporation of the dye into the yellow filter layer in place of colloidal silver results in remarkable increase in the sensitivity of the green-sensitive emulsion layer.

Specific examples of the compounds of formula (I) for use in the present invention are mentioned below, which, however, are not limitative.

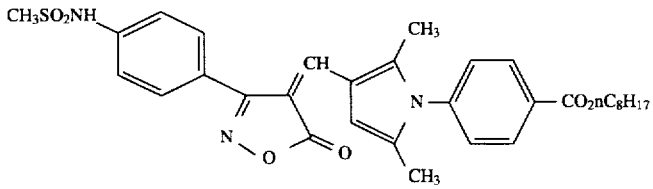

D-101

-continued
D-102
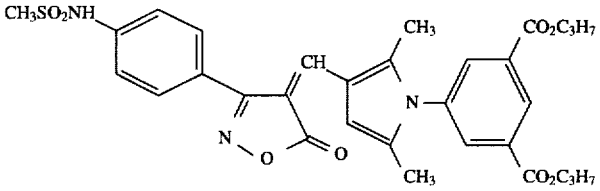
D-103
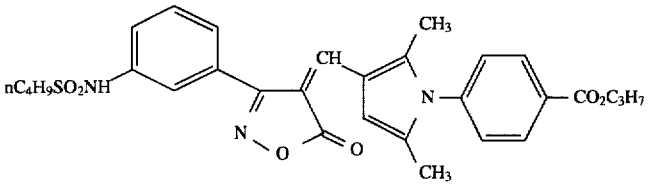
D-104
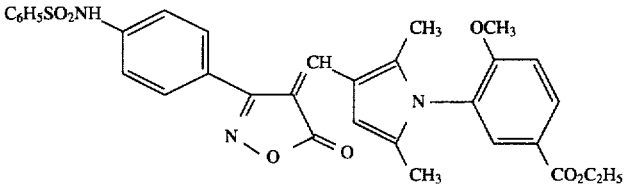
D-105
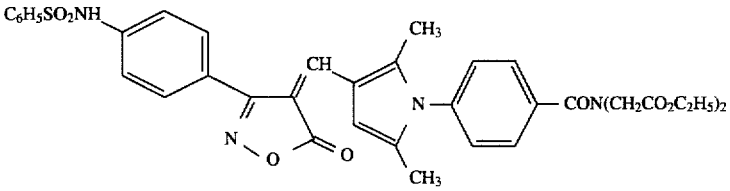
D-106
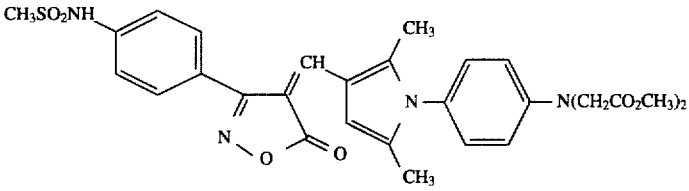
D-107
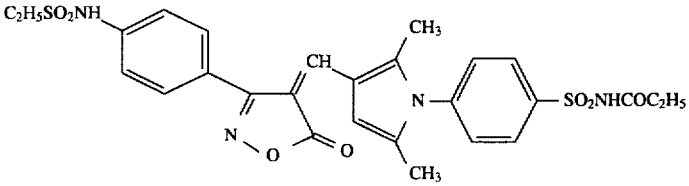
D-108
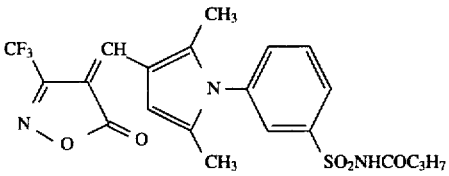
D-109
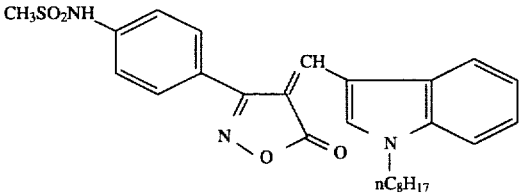

-continued
D-110
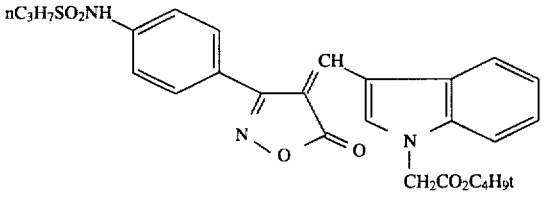
D-111
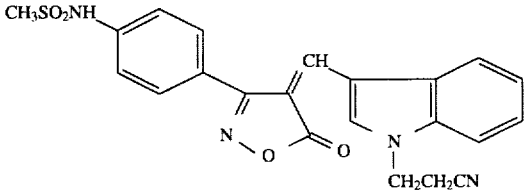
D-112
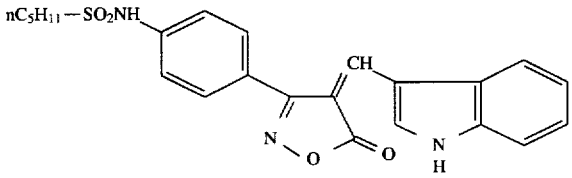
D-113
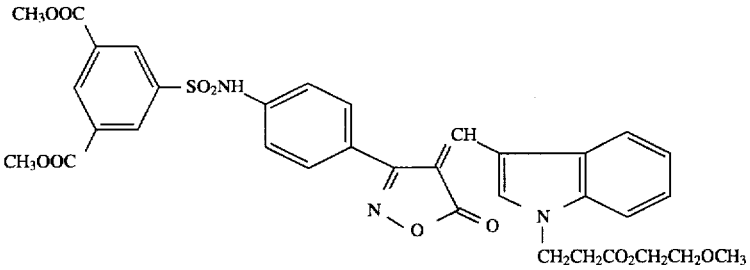
D-114
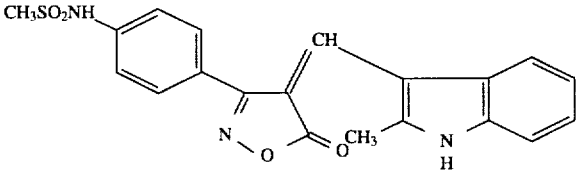
D-115
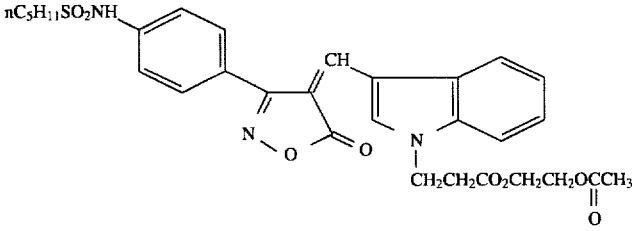
D-116
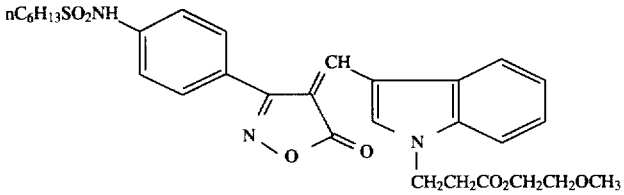

-continued
D-117
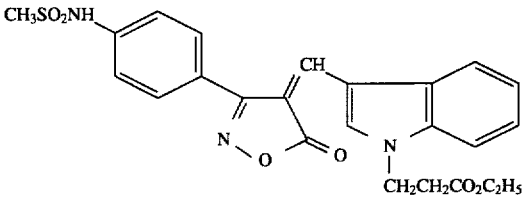
D-118
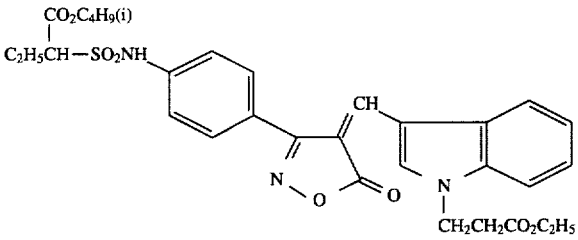
D-119
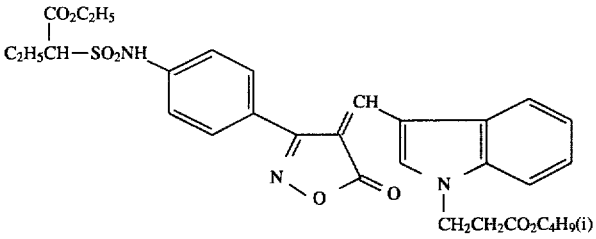
D-120
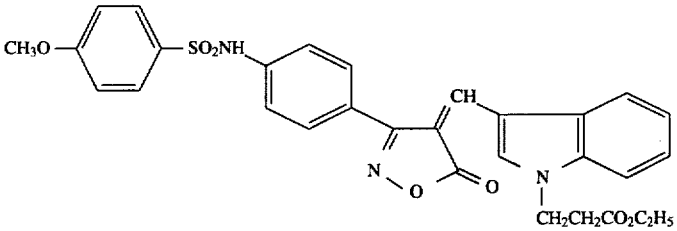
D-121
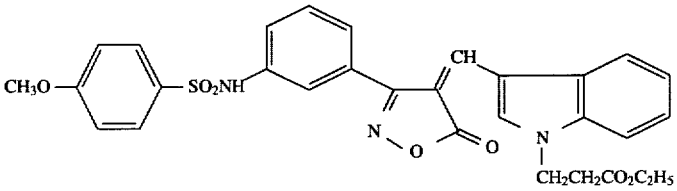
D-122
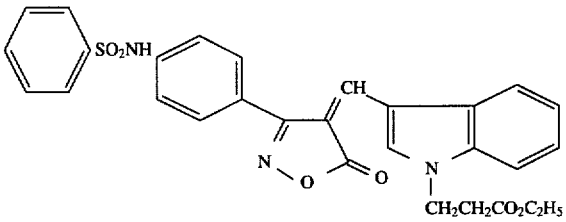
D-123
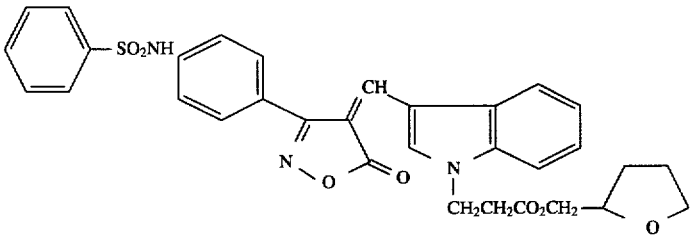

-continued
D-124
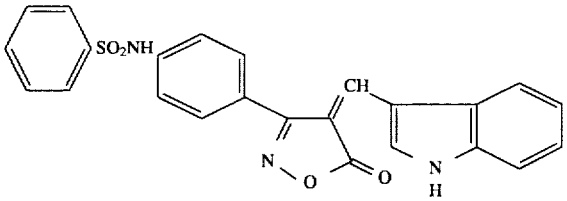
D-125
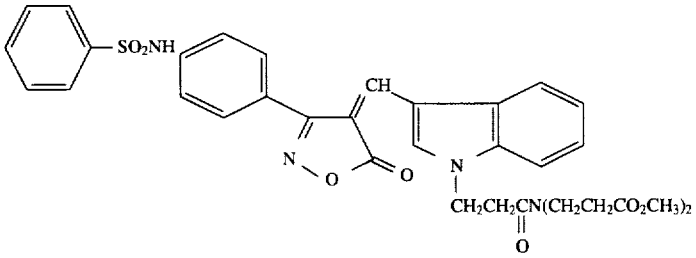
D-126
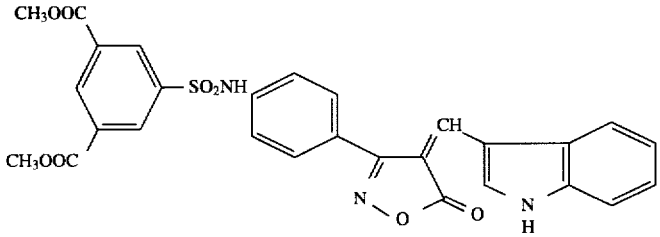
D-127
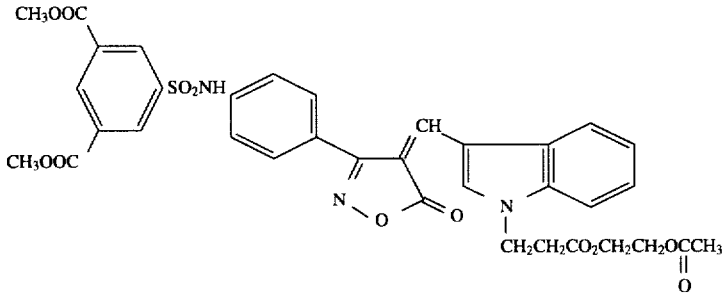
D-128
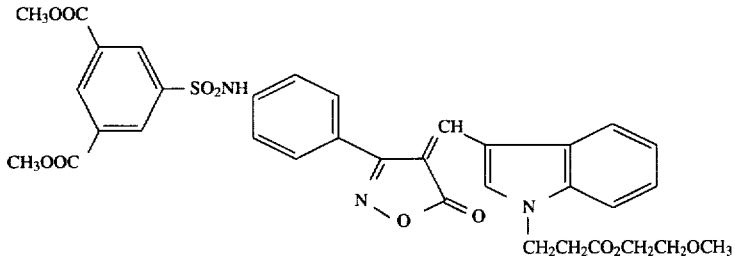
D-129
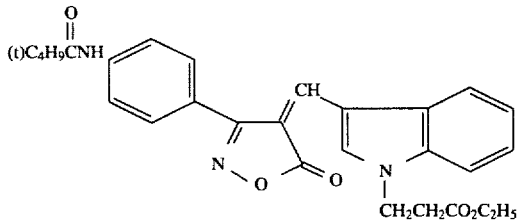

-continued
D-130
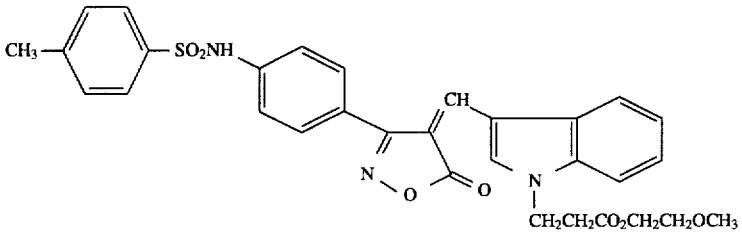
D-201
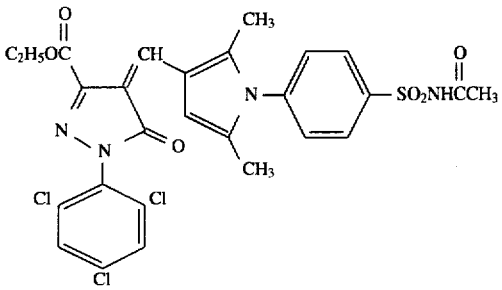
D-202
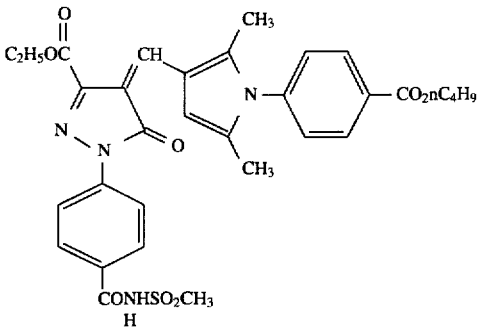
D-203
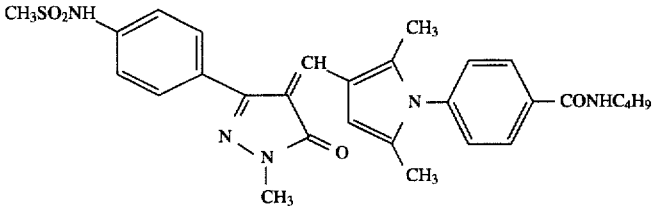
D-204
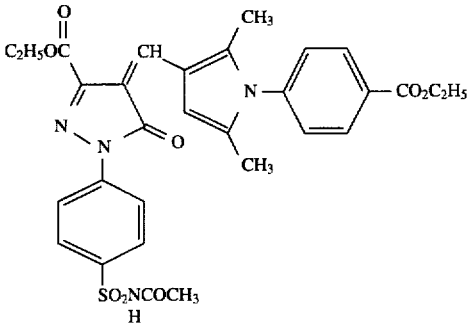

-continued
D-205
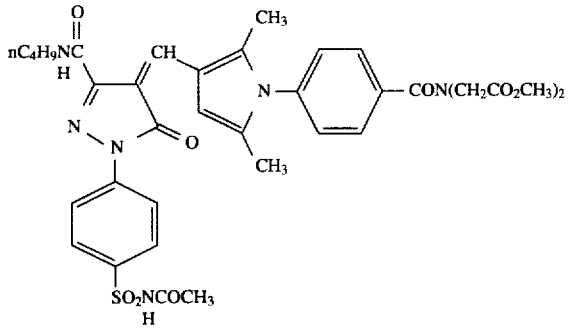
D-206
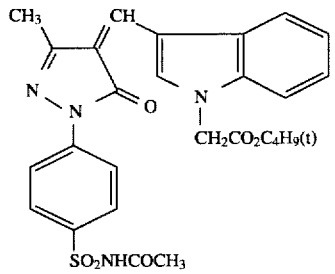
D-207
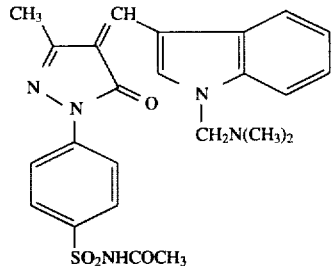
D-208
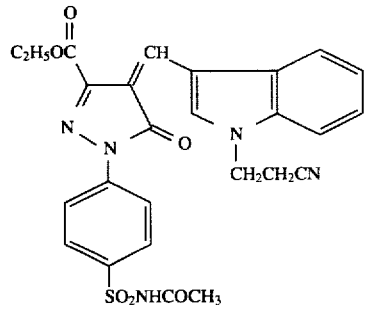
D-209
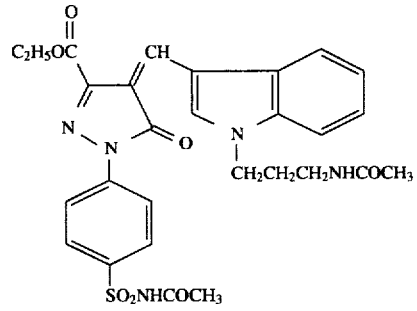

-continued
D-210
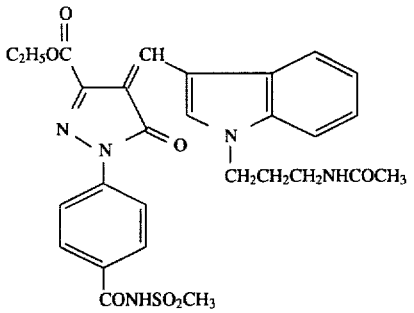
D-211
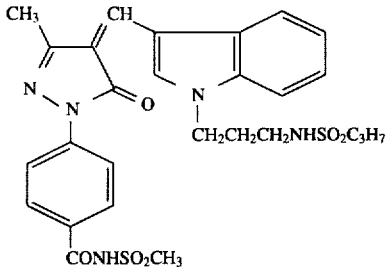
D-212
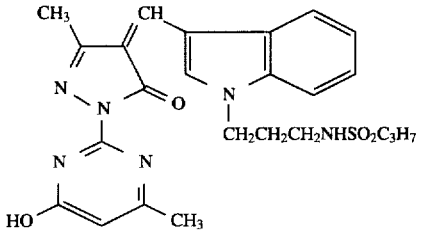
D-213
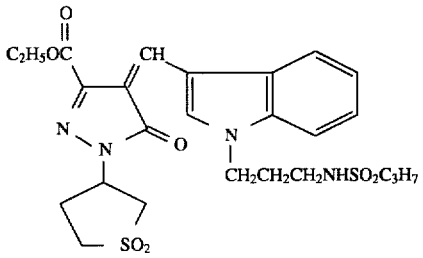
D-214
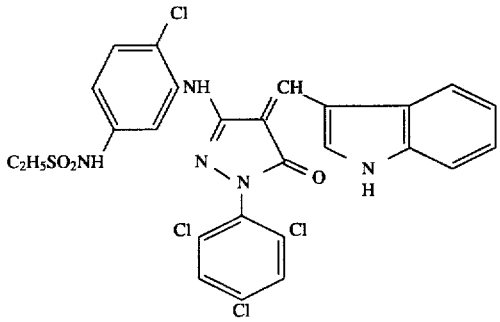

-continued

D-215

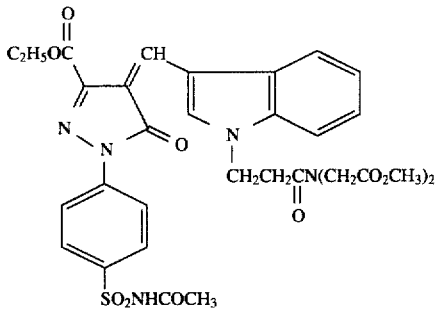

D-216

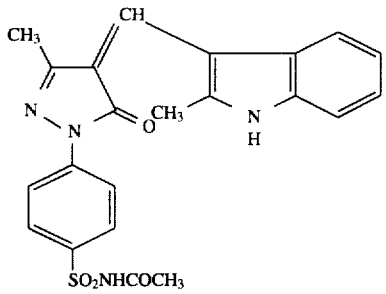

The compounds of formula (I) may be synthesized according to the methods described in JP-A-4-348342.

The sensitizing dyes of formulae (II) and (III) will be explained in detail hereunder.

In formula (II), $Z_{11}$ represents an atomic group necessary for forming a benzene ring, and at least one atom in the atomic group may optionally be substituted by an alkyl group, an alkoxy group or an aryloxy group, which has 0 to 20 carbon atoms. Preferably, the 6-position of the benzene ring formed by $Z_{11}$ is substituted by an alkyl group. The alkyl group capable of being the substituent for $Z_{11}$ includes, for example, methyl, ethyl, n-propyl, isopropyl, t-butyl, n-butyl, n-octyl, n-decyl, n-hexadecyl, cyclopentyl and cyclohexyl groups. Preferred are methyl and ethyl groups.

The alkoxy group includes, for example, methoxy, ethoxy and propoxy groups. Preferred is methoxy group.

The aryloxy group includes, for example, phenoxy, 4-methylphenoxy and 4-chlorophenoxy groups. Preferred is phenoxy group.

$Z_{12}$ represents an atomic group necessary for forming a benzothiazole nucleus or benzoselenazole nucleus, which may optionally be substituted. Preferably, $Z_{12}$ forms a benzothiazole nucleus substituted at its 5-position by a halogen atom, an alkyl group, an alkoxy group, an alkylthio group or an aryl group, which has 0 to carbon atoms. The halogen atom capable of being the substituent for the benzothiazole nucleus includes, for example, fluorine, chlorine, bromine and iodine atoms. Preferred are bromine and chlorine atoms.

The alkyl group may optionally be substituted, including, for example, methyl, ethyl, n-propyl, isopropyl, t-butyl, n-butyl, n-octyl, n-decyl, n-hexadecyl, cyclopentyl, cyclohexyl, trifluoromethyl and hydroxyethyl groups. Preferred is trifluoromethyl group. The alkoxy group includes, for example, methoxy, ethoxy, propoxy and methylenedioxy groups. Preferred is methoxy group.

The alkylthio group includes, for example, methylthio, ethylthio and propylthio groups. Preferred is methylthio group.

The aryl group includes, for example, phenyl, pentafluorophenyl, 4-chlorophenyl, 3-sulfophenyl and 4-methylphenyl groups. Preferred is phenyl group.

The alkyl group represented by $R_{11}$ and $R_{12}$ in formula (II) may optionally be substituted, preferably including, for example, an alkyl group having 8 or less atoms (e.g., methyl, ethyl, n-propyl, isopropyl, n-butyl, n-pentyl, n-hexyl, n-octyl), an aralkyl group having 10 or less carbon atoms (e.g., benzyl, phenethyl, 3-phenylpropyl), and an alkyl group having 6 or less carbon atoms and substituted by one or more substituents chosen from among a hydroxyl group, a carboxyl group, a sulfo group, a cyano group, a halogen atom (e.g., fluorine, chlorine, bromine, iodine), an alkoxycarbonyl group having 8 or less carbon atoms (e.g., methoxycarbonyl, ethoxycarbonyl, benzyloxycarbonyl), an alkoxy group having 8 or less carbon atoms (e.g., methoxy, ethoxy, propoxy, butyloxy, benzyloxy, phenethyloxy), an aryloxy group having 8 or less carbon atoms (e.g. , phenoxy, p-tolyloxy), an acyloxy group having 8 or less carbon atoms (e.g., acetyloxy, propionyloxy, benzoyloxy), an acyl group having 8 or less carbon atoms (e.g., acetyl, propionyl, benzoyl, 4-fluorobenzoyl), a carbamoyl group having 6 or less carbon atoms (e.g., carbamoyl, N,N-dimethylcarbamoyl, morpholinocarbonyl, piperidinocarbonyl), a sulfamoyl group having 6 or less carbon atoms (e.g., sulfamoyl, N,N-dimethylsulfamoyl, morpholinosulfonyl, piperidinosulfonyl) and an aryl group having 10 or less carbon atoms (e.g., phenyl, p-fluorophenyl, p-carboxyphenyl, p-hydroxyphenyl, p-sulfophenyl).

More preferably, the alkyl group represented by $R_{11}$ and $R_{12}$ is sulfoethyl, sulfobutyl, carboxymethyl or carboxyethyl group.

In formula (II), $X_{11}$ represents a charge-balancing counter ion. An ion that counterbalances a charge in the molecule, is chosen from anions or cations. The anions include, for example, inorganic or organic acid anions (e.g., p-toluenesulfonato, p-nitrobenzenesulfonato, methanesulfonato, methylsulfato, ethylsulfato, perchlorato) and halide ions (e.g., chloride, bromide, iodide). The cations may be either inorganic or organic, including, for example, hydrogen ion, alkali metal ions (e.g., lithium, sodium, potassium, cesium ions), alkaline earth metal ions (e.g., magnesium, calcium, strontium ions) and ammonium ions (e.g., organic ammonium, triethanolammonium, pyridinium ions).

Suffix m in formula (II) is 0 or 1, and it is 0 when the formula forms an internal salt.

Formula (III) will be explained in more detail hereunder.

$R_{21}$ and $R_{22}$ in formula (III) have the same meanings as $R_{11}$ and $R_{12}$, respectively, in formula (II). Preferably, they include sulfoethyl, sulfopropyl, sulfobutyl, carboxymethyl and carboxyethyl groups.

In formula (III), $X_{21}$ has the same meaning as $Z_{11}$ in formula (II), and $Z_{21}$ and n have the same meanings as $X_{11}$ and m, respectively, in formula (II).

$Z_{22}$ represents an atomic group necessary for forming a benzoxazole nucleus or naphthoxazole nucleus, which may optionally be substituted. Preferably, $Z_{22}$ forms a benzoxazole nucleus substituted at its 5-position by a halogen atom, an alkyl group, an alkoxy group, an alkylthio group or an arylthio group. The halogen atom capable of being the substituent for the benzoxazole nucleus includes, for example, fluorine, chlorine, bromine and iodine atoms. Preferred are bromine and chlorine atoms.

The alkyl group may optionally be substituted, including, for example, methyl, ethyl, n-propyl, isopropyl, t-butyl, n-butyl, n-octyl, n-decyl, n-hexadecyl, cyclopentyl, cyclohexyl, trifluoromethyl and hydroxyethyl groups. Preferred is trifluoromethyl group.

The alkoxy group includes, for example, methoxy, ethoxy and propoxy groups. Preferred is methoxy group.

The alkylthio group includes, for example, methylthio, ethylthio and propylthio groups. Preferred is methylthio group.

The aryl group includes, for example, phenyl, pentafluorophenyl, 4-chlorophenyl, 3-sulfophenyl and 4-methylphenyl groups. Preferred is phenyl group.

Of these sensitizing dyes for use in the present invention, more preferred are at least one dye of formula (IV) and at least one dye of formula (V).

In formulae (IV) and (V), $R_{31}$, $R_{32}$, $R_{41}$ and $R_{42}$ each represent a sulfoalkyl group or a carboxyalkyl group, preferably sulfoethyl, sulfopropyl, sulfobutyl, carboxymethyl or carboxyethyl group.

$X_{31}$ and $X_{41}$ each has the same meaning as $X_{11}$ in formula (II). Suffix l and p each has the same meaning as m in formula (II).

$W_{31}$, $W_{32}$ and $W_{41}$ each represents an alkyl group having 3 or less carbon atoms, a halogen atom, an aryl group or an aryloxy group, preferably methyl, ethyl, chlorine, bromine, phenyl or phenoxy group. Especially preferably, the quinoline nucleus in the formulae has methyl group or chlorine atom at its 6-position. $W_{33}$ and $W_{42}$ each represent a halogen atom or an aryl group, preferably chlorine, bromine, phenyl or p-tolyl group, especially preferably chlorine or phenyl.

Specific examples of the sensitizing dyes of formulae (II) and (III) for use in the present invention are mentioned below, which, however, are not limitative.

| No. | $W_1$ | $W_2$ | $W_3$ | $W_4$ | $R_{11}$ | $R_{12}$ | $X_{11}$ |
|---|---|---|---|---|---|---|---|
| | | | 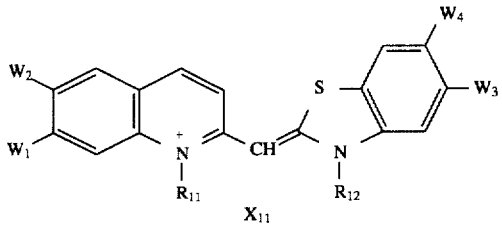 | | | | |
| II-1 | H | $CH_3$ | Cl | H | $-(CH_2)_4SO_3-$ | $-(CH_2)_4SO_3-$ | $HN(C_2H_5)_3^+$ |
| II-2 | $CH_3$ | $CH_3$ | Cl | $CH_3$ | $-(CH_2)_2SO_3-$ | $-(CH_2)_4SO_3-$ | $Na^+$ |
| II-3 | H | $CH_3$ | 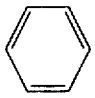 | H | $-(CH_2)_3SO_3-$ | $-(CH_2)_2SO_3-$ | $K^+$ |
| II-4 | H | $C_2H_5$ | 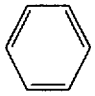 | H | $-CH_2COOH$ | $-(CH_2)_4SO_3-$ | — |
| II-5 | H | 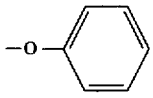 | Cl | H | $-(CH_2)_2COOH$ | $-CH_2CH_2\underset{\underset{CH_3}{\vert}}{C}HSO_3^-$ | — |
| II-6 | H | H | H | H | $C_2H_5$ | $C_2H_5$ | $I^-$ |
| II-7 | H | $CH_3$ | OH | H | $-(CH_2)_4SO_3-$ | $C_2H_5$ | — |
| II-8 | H | H | H | H | $C_2H_5$ | $-CH_2CH_2\underset{\underset{CH_3}{\vert}}{C}HSO_3^-$ | — |
| II-9 | H | Cl | Cl | $CH_3$ | $-(CH_2)_4SO_3-$ | $-(CH_2)_4SO_3-$ | $Na^+$ |
| II-10 | H | Cl | 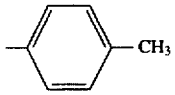 | H | $-CH_2CONHSO_2CH_3$ | $-(CH_2)_4SO_3-$ | — |

-continued

II-11

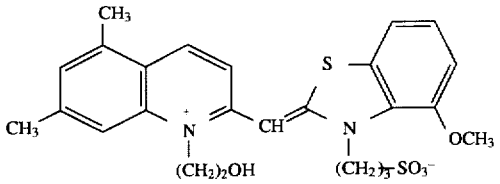

II-12

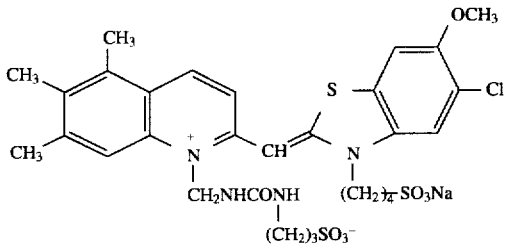

II-13

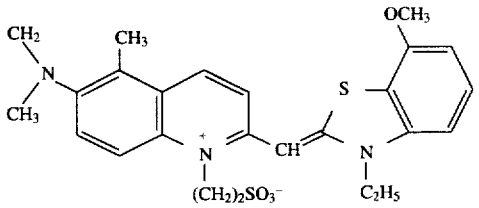

II-14

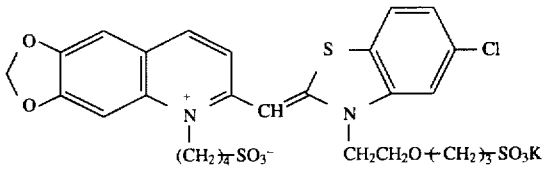

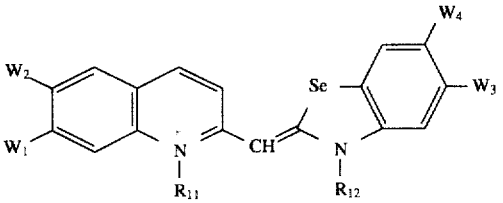

$X_{11}$

| No. | $W_1$ | $W_2$ | $W_3$ | $W_4$ | $R_{11}$ | $R_{12}$ | $X_{11}$ |
|---|---|---|---|---|---|---|---|
| II-15 | H | H | H | H | $C_2H_5$ | $C_2H_5$ | $I^-$ |
| II-16 | H | $CH_3$ | $OCH_3$ | $CH_3$ | $C_2H_5$ | $C_2H_5$ | $I^-$ |
| II-17 | H | $CH_3$ | $OCH_3$ | H | $C_2H_5$ | $-(CH_2)_4SO_3-$ | — |
| II-18 | H | $CH_3$ | $OCH_3$ | H | $-(CH_2)_3SO_3-$ | $-(CH_2)_3SO_3-$ | $H^+$ |
| II-19 | H | $C_2H_5$ | Cl | H | $-(CH_2)_4SO_3-$ | $-(CH_2)_4SO_3-$ | $Na^+$ |
| II-20 | H | $-O-C_6H_4-$ | Cl | H | $-CH_2CH_2CH(CH_3)SO_3^-$ | $-CH_2COOH$ | — |
| II-21 | $CH_3$ | $CH_3$ | Cl | H | $-(CH_2)_2SO_3-$ | $-(CH_2)_4SO_3-$ | $HN(C_2H_5)_3+$ |
| II-22 | H | Cl | H | $CH_3$ | $-CH_2CONHSO_2CH_3$ | $-CH_2CONHSO_2CH_3$ | $Br^-$ |
| II-23 | H | $-N(CH_3)_2$ | H | $OCH_3$ | $-(CH_2)_2OH$ | $-(CH_2)_2SO_3-$ | — |
| II-24 | $CH_3$ | $C_2H_5$ | OH | H | $-(CH_2)_3OCOCH_3$ | $-(CH_2)_4SO_3-$ | — |
| II-25 | $CH_3$ | $-O-C_6H_4-$ | Cl | $OCH_3$ | $-(CH_2)_4SO_3-$ | $-(CH_2)_2NHCOCH_3$ | — |

II-26

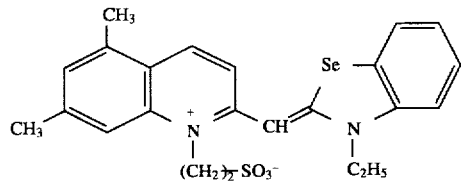

II-27

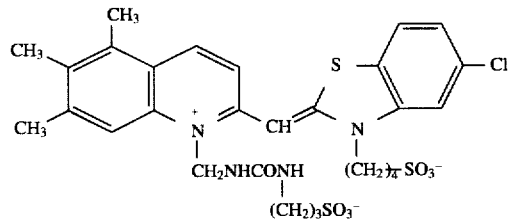

-continued

II-28

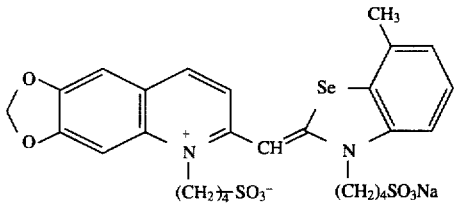

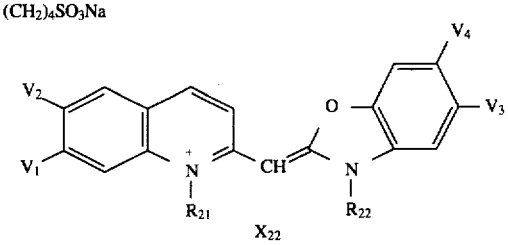

| No. | $V_1$ | $V_2$ | $V_3$ | $V_4$ | $R_{21}$ | $R_{22}$ | $X_{22}$ |
|---|---|---|---|---|---|---|---|
| III-1 | H | $CH_3$ | 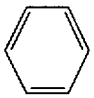 | H | $-(CH_2)_4SO_3-$ | $-(CH_2)_4SO_3-$ | $Na^+$ |
| III-2 | H | H | H | H | $C_2H_5$ | $C_2H_5$ | $I^-$ |
| III-3 | H | $CH_3$ | Cl | H | $-(CH_2)_2SO_3-$ | $-(CH_2)_3SO_3-$ | $K^+$ |
| III-4 | H | $CH_3$ | Cl | $CH_3$ | $-(CH_2)_3SO_3-$ | $-CH_2COOH$ | — |
| III-5 | H | $CH_3$ | 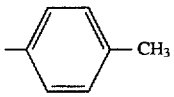 | H | $-CH_2CH_2CH(CH_3)SO_3^-$ | $-(CH_2)_4SO_3-$ | $Na^+$ |
| III-6 | H | $C_2H_5$ | $CH_3$ | H | $CH_2CH_2OH$ | $-(CH_2)_2SO_3-$ | — |
| III-7 | H | Cl | H | $OCH_3$ | $-(CH_2)_3SO_3-$ | $-(CH_2)_3SO_3-$ | $K^+$ |
| III-8 | H | 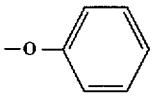 | $CH_3$ | $CH_3$ | $C_2H_5$ | $-(CH_2)_4SO_3-$ | — |
| III-9 | $CH_3$ | H | 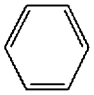 | H | $-CH_2CONHSO_2CH_3$ | $-(CH_2)_2SO_3-$ | — |
| III-10 | $CH_3$ | $CH_3$ | Cl | H | $-CH_2$ 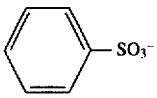 | $-(CH_2)_4SO_3-$ | $Na^+$ |

III-11

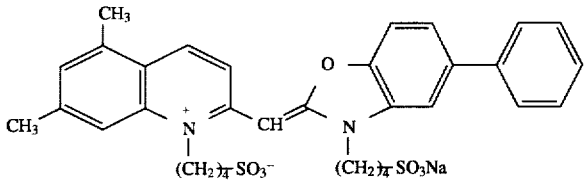

III-12

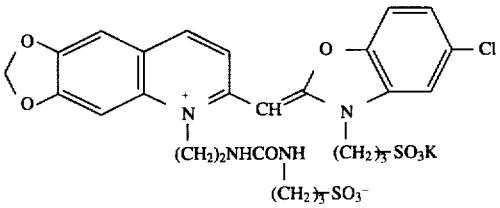

III-13

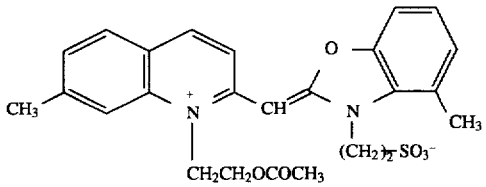

III-13

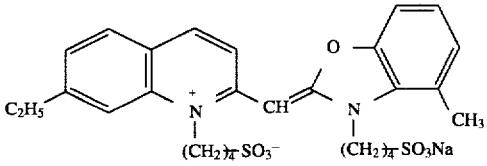

-continued
III-15
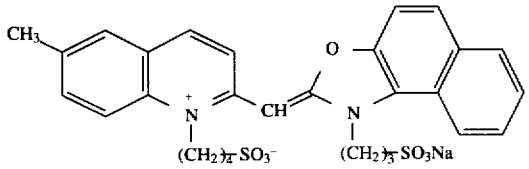
III-16
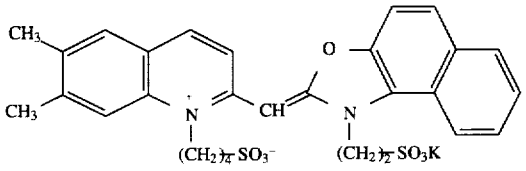
III-17
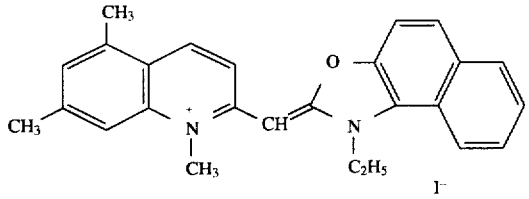
III-18
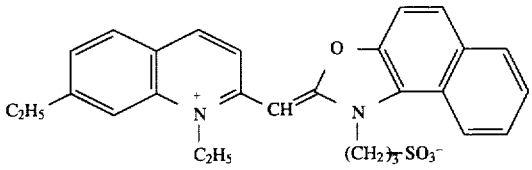
III-19
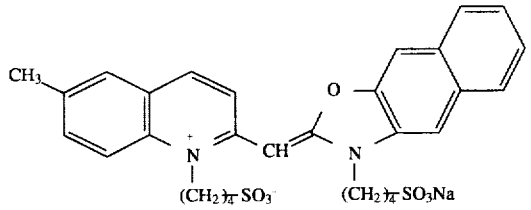
III-20
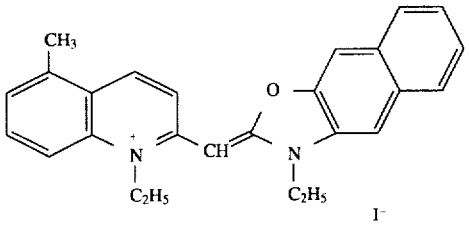
III-21
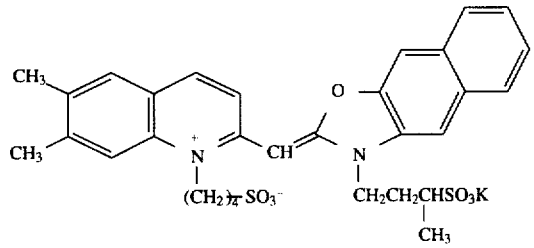
III-22
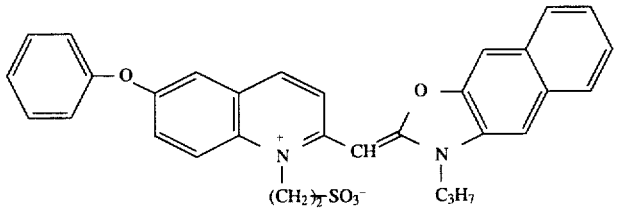
III-23
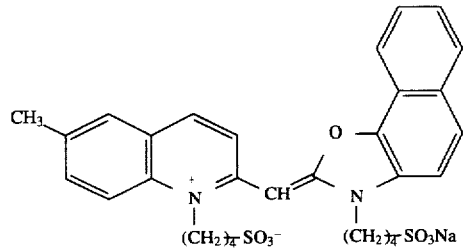
III-24
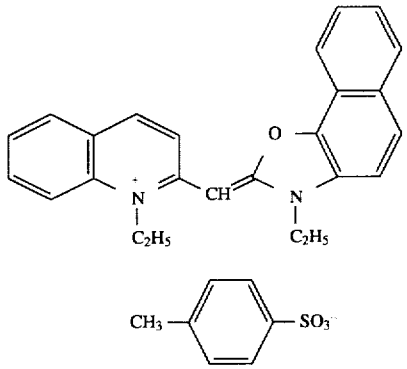

-continued

III-25

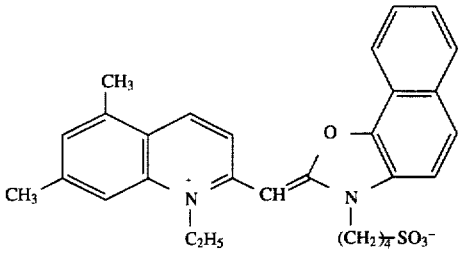

III-26

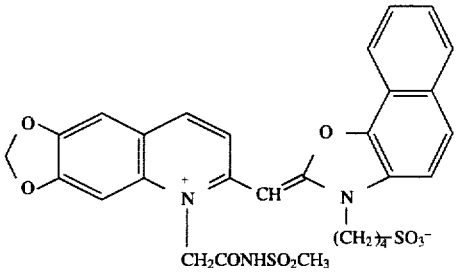

III-27

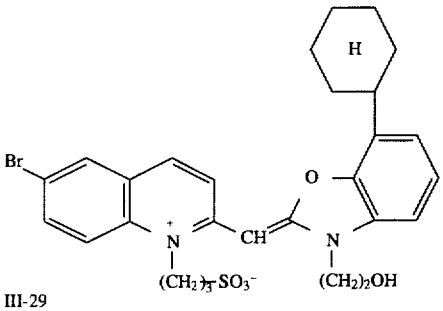

III-28

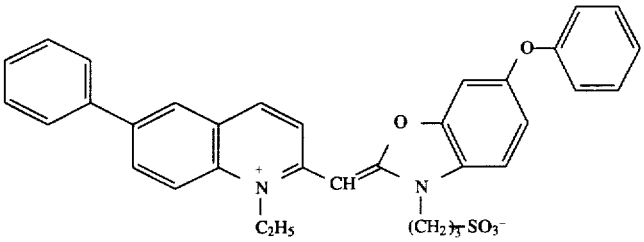

III-29

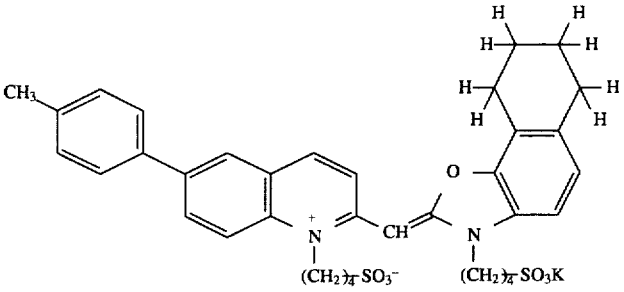

III-30

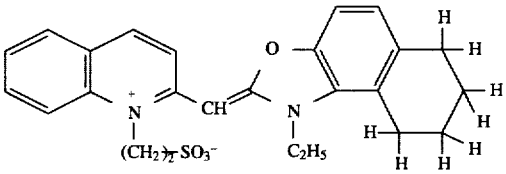

The compounds of formulae (II) and (III) for use in the present invention may be produced, for example, according to the methods described in F. M. Hamer, *Heterocyclic Compounds—Cyanine Dyes and Related Compounds* (published by John Wiley & Sons Co., New York, London in 1964); D. M. Sturmer, *Heterocyclic Compounds—Special Topics in Heterocyclic Chemistry,* Chap. 18, Par. 14, pp. 482 to 515 (published by Wiley & Sons Co., New York, London in 1977); *Rodd's Chemistry of Carbon Compounds* (published by Elsvier Science Publishing Company Inc., New York), 2nd Ed., Vol IV, Part B, (1977), Chap. 15, pp. 369 to 422; ibid., 2nd Ed., Vol IV, Part B, (1985), Chap. 15, pp. 267 to 296, etc.

An amount of the sensitizing dye of formula (II) or (III) to be used in the present invention is 10% or more of an amount of the dye used in the interlayer effect donor layer. Practically, it may be from $2\times10^{-6}$ to $1\times10^{-2}$ mol, more preferably from $8\times10^{-6}$ to $2\times10^{3}$ mol, per mol of the silver halide in the layer. Regarding the time when the dye is added to the emulsion, the dye may be added to the emulsion at any time that has heretofore been known useful in the field for preparing the photographic emulsions.

The above-mentioned sensitizing dyes may be combined with any other dyes but are preferably combined with cyanine dyes.

A position of the interlayer effect donor layer spectrally-sensitized with the sensitizing dyes of formulae (II) and (III) in the photographic material of the present invention is not specifically defined, provided that the layer is provided closer to the support than the hydrophilic colloid layer containing the compound of formula (I), and layer arrangements may freely be determined according to the object.

The silver halide to be preferably in the photographic emulsion layer of constituting the photographic material of the present invention is silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 10 mol %.

The silver halide grains to be in the photographic emulsions of constituting the photographic material of the present invention may be regular crystalline forms such as cubic, octahedral or tetradecahedral grains, or irregular crystalline forms such as spherical or tabular grains, or irregular crystalline forms having a crystal defect such as a twin plane, or composite crystalline composed of the above-mentioned crystalline forms.

Regarding the grain size of the silver halide grains, the grains may be fine grains having a small grain size of about 0.2 microns or less or may be large grains having a large grain size of up to about 10 microns calculated as the diameter of the projected area of the grains. The emulsion of the grains may be either a polydispersed emulsion or a monodispersed emulsion.

The silver halide photographic emulsions to be used in the present invention may be prepared by various methods, for example, those described in *Research Disclosure* (RD) No. 17643 (December, 1978), pp. 22 to 23 (I. Emulsion Preparation and Types); RD No. 18716 (November, 1979), p. 648; RD No. 307105 (November, 1989); P. Glafkides, *Chimie et Physique Photographigue* (published by Paul Montel, 1967); G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions as described in U.S. Pat. Nos. 3,574,628 and 3,655,394 and British Patent 1,413,748 are also preferably used in the present invention.

Especially preferably, the interlayer effect donor layer of the photographic material of the present invention contains tabular grains having an aspect ratio of 2 or more in an amount of 40% or more of the total projected area of all the silver halide grains in the layer.

The aspect ratio used herein means a ratio of the diameter of a silver halide grain with respect to the thickness thereof. That is, the aspect ratio is a value obtained by dividing the diameter of each silver halide grain by the thickness thereof. The diameter of the grain indicates a diameter of the circle having the same area as the projected area of the grain, when the silver halide emulsion is observed with a microscope or an electron microscope. Accordingly, the grain having an aspect ratio of 2 or more is such that the diameter of said circle is two times or more the thickness of the grain.

It is desired that the tabular silver halide grains to be used in the silver halide emulsion of the present invention each has a diameter of being two times or more the thickness of the grain, more preferably from 3 to 15 times the same, especially preferably from 4 to 10 times the same. The proportion of the tabular silver halide grains to all the silver halide grains in the emulsion is preferably 40% or more, more preferably 70% or more, especially preferably 85% or more, in terms of the projected area.

Tabular silver halide emulsions are described in, for example, Cugnac and Chateau's reports; Duffin, *Photographic Emulsion Chemistry.* (published by Focal Press, New York, in 1966), pp. 66 to 72; and A. P. H Trivelli and W. F. Smith, *Phot. Journal,* 80 (1940), p. 285, and these may easily be produced according to the methods described in JP-A-58-113927, 58-113928, 58-127921, etc.

Regarding the crystal structures of the silver halide grains, the grains may have the same halogen composition throughout the whole grain, or they may have different halogen compositions between the inner part and the outer part of grain, or they may have a layered structure. Further, the grains may have different layered halogen compositions as formed by epitaxial bonding, or they may have components other than silver halides, such as silver rhodanide or lead oxide, as bonded with the silver halide matrix. Additionally, a mixture of various grains of different crystalline forms may be employed in the present invention.

The above-mentioned emulsions may be a surface latent image type emulsion, which forms latent images essentially on the surfaces of the grains, internal latent image type emulsion, which forms latent images essentially in the insides of the grains, or a composite emulsion, which forms latent images both on the surfaces and the insides of the grains. However, the emulsions must be negative type. Of the internal latent image type emulsions, core/shell type internal latent image type emulsions described in JP-A-63-264740 may also be used. Preparation of such core/shell type internal latent image type emulsions is disclosed in JP-A-59-133542. The preferred thickness of the shell of the grains in the emulsion is, though varying in accordance with the way of development of the material, etc., from 3 to 40 nm, especially preferably from 5 to 20 nm.

The emulsions are generally physically ripened, chemically ripened and/or spectrally-sensitized. Additives to be used in such a ripening or sensitizing step are described in *Research Disclosure* Nos. 17643, 18716 and 307105, and the related descriptions in these references are summarized in the table mentioned below.

| Kind of Additives | RD 17643 (Dec. 1978) | RD 18716 (Nov. 1979) | RD 307105 (Nov. 1989) |
|---|---|---|---|
| 1. Chemical Sensitizer | p. 23 | p. 648, right column | p. 866 |
| 2. Sensitivity Enhancer | | p. 648, right column | |
| 3. Spectral Sensitizer Supercolor Sensitizer | pp. 23 to 24 | p. 648, right column to p. 649, right column | pp. 866 to 868 |
| 4. Whitening Agent | p. 24 | p. 647, right column | p. 868 |
| 5. Anti-foggant Stabilizer | pp. 24 to 25 | p/ 649, right column | pp. 868 to 870 |
| 6. Light-Absorbent Filter Dye Ultraviolet Absorbent | pp. 25 to 26 | p. 649, right column to p. 650, left column | p. 873 |
| 7. Stain Inhibitor | p. 25, right column | p. 650, left to right column | p. 872 |
| 8. Color Image Stabilizer | p. 25 | p. 650, left column | p. 872 |
| 9. Hardening Agent | p. 26 | p. 651, left column | pp. 875 to 875 |
| 10. Binder | p. 26 | p. 651, left column | pp. 873 to 874 |
| 11. Plasticizer Lubricant | p. 27 | p. 650, right column | p. 876 |
| 12. Coating Aid Surfactant | pp. 26 to 27 | p. 650, right column | pp. 875 to 876 |
| 13. Antistatic Agent | p. 27 | p. 650, right column | pp. 876 to 877 |
| 14. Matting Agent | | | pp. 878 to 879 |

Various techniques and inorganic and organic materials which are employable in carrying out the present invention are described in European Patent 436,938A2 and other patents mentioned below.

| | |
|---|---|
| 1. Layer Configuration | EP 436,938A2, from page 146, line 34 to page 147, line 25 |
| 2. Yellow Couplers | EP 436,938A2, from page 137, line 35 to page 146, line 33, and page 149, lines 21 to 23 |
| 3. Magenta Couplers | EP 436,938A2, page 149, lines 24 to 28; EP 421,453A1, from page 3, line 5 to page 25, line 55 |
| 4. Cyan Couplers | EP 436,938A2, page 149, lines 29 to 33; EP 432,804A2, from page 3, line 28 to page 40, line 2 |
| 5. Polymer Couplers | EP 436,938A2, page 149, lines 34 to 38; EP 435,334A2, from page 113, line 39 to page 123, line 37 |
| 6. Colored Couplers | EP 436,938A2, from page 53, line 42 to page 137, line 34, and page 149, lines 39 to 45 |
| 7. Other Functional Couplers | EP 436,938A2, from page 7, line 1 to page 53, line 41, and from page 149, line 46 to page 150, line 3; EP 435,334A2, from page 3, line 1 to page 29, line 50 |
| 8. Antiseptics, Antifungals | EP 436,938A2, page 150, lines 25 to 28 |
| 9. Formalin Scavengers | EP 436,938A2, page 149, lines 15 to 17 |
| 10. Other Additives | EP 436,938A2, page 153, lines 38 to 47; EP 421,453A1, from page 75, line 21 to page 84, lines 56, and from page 27, line 40 to page 37, line 40 |
| 11. Dispersing Methods | EP 436,938A2, page 150, lines 4 to 24 |
| 12. Supports | EP 436,938A2, page 150, lines 32 to 34 |
| 13. Thickness of Films, Properties of Films | EP 436,938A2, page 150, lines 35 to 49 |
| 14. Color Development Steps | EP 436,938A2, from page 150, line 50 to page 151, line 47 |
| 15. Desilvering Steps | EP 436,938A2, from page 151, line 48 to page 152, line 53 |
| 16. Automatic Developing Machines | EP 436,938A2, from page 152, line 54 to page 153, line 2 |
| 17. Rinsing and Stabilizing Steps | EP 436,938A2, page 153, lines 3 to 37 |

The present invention will be explained in more detail by means of the following examples, which, however, are not intended to restrict the scope of the present invention.

EXAMPLE 1

Preparation of Emulsion M:

A liquid composition containing 30 g of inactive gelatin, 6 g of potassium bromide and one liter of distilled water was stirred at 75° C., to which added were 35 cc of an aqueous solution containing 5.0 g of silver nitrate and 35 cc of an aqueous solution containing 3.2 g of potassium bromide and 0.98 g of potassium iodide each at a flow rate of 70 cc/min for 30 seconds. Then, the mixture was ripened for 30 minutes, after the pAg thereof was elevated to 10.

Next, an aqueous solution containing 145 g of silver nitrate and one liter of distilled water and an aqueous solution containing a mixture of potassium bromide and potassium iodide were added thereto in equimolar amounts, each at a flow rate near to the critical growth rate of the grains being formed, to prepare an emulsion (Emulsion M) containing core/shell type silver iodobromide grains having a mean aspect ratio of 1.4, a mean iodine content of 5.2 mol % and a mean grain size of 0.8 μm.

Preparation of Emulsion N:

A liquid composition comprising 10.5 g of inactive gelatin, 3 g of potassium bromide and one liter of distilled water was stirred at 60° C., to which added were 35 cc of an aqueous solution containing 5.0 g of silver nitrate and 35 cc of an aqueous solution containing potassium bromide of the same molar amount as the amount of the nitrate, each at a flow rate of 70 cc/min for one minute. Then, the mixture was heated up to 75° C., and an aqueous solution containing 136.3 g of silver nitrate and an aqueous halide solution (containing potassium iodide in an amount of 3 mol % with respect to potassium bromide and potassium iodide) were added thereto by a double jet method over a period of 50 minutes, while the silver potential was kept at 10 mV relative to the saturated calomel electrode.

Afterwards, the aqueous potassium iodide solution was added thereto over a period of 3 minutes, and then the aqueous silver nitrate solution and the aqueous potassium bromide solution were added thereto by a double jet method to prepare an emulsion (Emulsion N) containing tabular silver iodobromide grains having a mean aspect ratio of 5.4, a mean iodine content of 5.4 mol % and a mean grain size of 0.71 μm.

Emulsions M and N were observed with an electron microscope. The proportion of tabular grains having an aspect ratio of 2 or more to all the grains in the emulsion was 18% in Emulsion M and 56% in Emulsion N, in terms of the projected area.

A multi-layer color photographic material (Sample No. 101) was prepared on a cellulose triacetate film support having a subbing layer, by forming plural layers each having the composition mentioned below. Compositions of Photographic Layers:

The amounts of the silver halide and the colloidal silver coated each was shown in a unit of g/m$^2$ of silver therein. The amounts of the coupler, the additive and the gelatin coated each was shown in a unit of g/m$^2$. The amount of the sensitizing dye coated was represented by the number of mols per mol of the silver halide in the same layer. The additives were represented by their abbreviations mentioned below. For additives having plural effects, one typical effect thereof was referred to.

UV: ultraviolet absorbent

Solv: high boiling point organic solvent

ExF: dye

ExS: sensitizing dye

ExC: cyan coupler

ExM: magenta coupler

ExY: yellow coupler

Cpd: additive

| First Layer (Anti-halation Layer): | |
|---|---|
| Black Colloidal Silver | 0.15 as Ag |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-5 | $1.0 \times 10^{-3}$ |
| Solv-1 | 0.16 |
| Solv-2 | 0.10 |

| | |
|---|---|
| Second Layer (Low-Sensitivity Red-Sensitive Emulsion Layer): | |
| Silver Iodobromide Emulsion A | 0.30 as Ag |
| Silver Iodobromide Emulsion B | 0.15 as Ag |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $5.0 \times 10^{-2}$ |
| ExC-3 | $4.0 \times 10^{-2}$ |
| ExC-5 | $8.0 \times 10^{2}$ |
| ExC-6 | $2.0 \times 10^{-2}$ |
| ExC-9 | $2.5 \times 10^{-2}$ |
| Cpd-4 | $2.2 \times 10^{-2}$ |
| Third Layer (Middle-Sensitivity Red-Sensitive Emulsion Layer): | |
| Silver Iodobromide Emulsion C | 0.65 as Ag |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
| ExC-9 | $3.0 \times 10^{-2}$ |
| Cpd-4 | $1.5 \times 10^{-2}$ |
| Fourth Layer (High-Sensitivity Red-Sensitive Emulsion Layer): | |
| Silver Iodobromide Emulsion D | 1.05 as Ag |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Solv-1 | 0.70 |
| Solv-2 | 0.13 |
| Fifth Layer (Interlayer): | |
| Gelatin | 0.62 |
| Cpd-1 | 0.13 |
| Polyethyl Acrylate Latex | $8.0 \times 10^{-2}$ |
| Solv-1 | $8.0 \times 10^{-2}$ |
| Sixth Layer (Low-Sensitivity Green-Sensitive Emulsion Layer): | |
| Silver Iodobromide Emulsion E | 0.12 as Ag |
| Silver Iodobromide Emulsion F | 0.38 as Ag |
| Gelatin | 0.31 |
| ExS-3 | $1.0 \times 10^{-4}$ |
| ExS-4 | $3.8 \times 10^{-4}$ |
| ExS-5 | $6.4 \times 10^{-5}$ |
| ExM-1 | 0.14 |
| ExM-7 | $2.4 \times 10^{-2}$ |
| Solv-1 | 0.09 |
| Solv-3 | $8.2 \times 10^{-3}$ |
| Seventh Layer (Middle-Sensitivity Green-Sensitive Emulsion Layer): | |
| Silver Iodobromide Emulsion G | 0.28 as Ag |
| Gelatin | 0.40 |
| ExS-3 | $2.0 \times 10^{-4}$ |
| ExS-4 | $5.7 \times 10^{-4}$ |
| ExS-5 | $1.3 \times 10^{-4}$ |

| | |
|---|---|
| ExM-1 | 0.27 |
| ExM-7 | $5.4 \times 10^{-2}$ |
| ExY-1 | $4.2 \times 10^{-2}$ |
| Solv-1 | 0.20 |
| Solv-3 | $1.5 \times 10^{-2}$ |
| Eighth Layer (High-Sensitivity Green-Sensitive Emulsion Layer): | |
| Silver Iodobromide Emulsion H | 0.58 as Ag |
| Gelatin | 0.61 |
| ExS-4 | $4.7 \times 10^{-4}$ |
| ExS-5 | $9.4 \times 10^{-5}$ |
| ExS-8 | $3.0 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| Ninth Layer (Interlayer): | |
| Gelatin | 0.56 |
| UV-4 | $4.0 \times 10^{-2}$ |
| UV-4 | $3.0 \times 10^{-2}$ |
| Cpd-1 | $4.0 \times 10^{2}$ |
| Polyethyl Acrylate Latex | $5.0 \times 10^{-2}$ |
| Solv-1 | $3.0 \times 10^{-2}$ |
| Tenth Layer (Interlayer Effect Donor Layer to Red-Sensitive Layer): | |
| Silver Iodobromide Emulsion M | 1.00 as Ag |
| Gelatin | 0.87 |
| ExS-3 | $6.7 \times 10^{-4}$ |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |
| Eleventh Layer (Yellow Filter Layer): | |
| Yellow Colloidal Silver | $9.0 \times 10^{-2}$ as Ag |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| Twelfth Layer (Low-Sensitivity Blue-Sensitive Emulsion Layer): | |
| Silver Iodobromide Emulsion I | 0.50 as Ag |
| Silver Iodobromide Emulsion J | 0.40 as Ag |
| Gelatin | 1.75 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |
| ExC-2 | $8.0 \times 10^{-2}$ |
| Solv-1 | 0.54 |
| Thirteenth Layer (Interlayer): | |
| Gelatin | 0.30 |
| ExY-4 | 0.14 |
| Solv-1 | 0.14 |
| Fourteenth Layer: (High-Sensitivity Blue-Sensitive Emulsion Layer): | |
| Silver Iodobromide Emulsion K | 0.40 as Ag |
| Gelatin | 0.95 |
| ExS-6 | $2.6 \times 10^{-4}$ |
| ExY-2 | $1.0 \times 10^{-2}$ |
| ExY-3 | $2.0 \times 10^{-2}$ |

-continued

| | |
|---|---|
| ExY-5 | 0.18 |
| ExC-1 | $1.0 \times 10^{-2}$ |
| Solv-1 | $9.0 \times 10^{-2}$ |
| Fifteenth Layer (First Protective Layer): | |
| Fine Silver Iodobromide Grain Emulsion L | 0.12 as Ag |
| Gelatin | 0.63 |
| UV-4 | 0.11 |
| UV-5 | 0.18 |
| Cpd-3 | 0.10 |
| Solv-5 | $2.0 \times 10^{-2}$ |
| Polyethyl Acrylate Latex | $9.0 \times 10^{-2}$ |
| Sixteenth Layer (Second Protective Layer): | |
| Fine Silver Iodobromide Grain Emulsion L | 0.36 as Ag |
| Gelatin | 0.85 |
| B-1 (diameter 2.0 μm) | $8.0 \times 10^{-2}$ |
| B-2 (diameter 2.0 μm) | $8.0 \times 10^{-2}$ |
| B-3 | $2.0 \times 10^{-2}$ |
| W-5 | $2.0 \times 10^{-2}$ |
| H-1 | 0.18 |

The sample further contained, in addition to the above-mentioned components, 1,2-benzisothiazolin-3-one (200 ppm to gelatin on average), n-butyl p-hydroxybenzoate (about 1,000 ppm to gelatin on average), and 2-phenoxyethanol (about 10,000 ppm to gelatin on average). In addition, it further contained (W-1) to (W-6), (B-1) to (B-6), (F-1) to (F-16) as well as iron salt, lead salt, gold salt, platinum salt, iridium salt and rhodium salt so as to improve its storage stability, processability, pressure resistivity, anti-fungal and anti-bacterial property, antistatic property and coatability.

according to the example in JP-A-2-191938, when the grains were prepared.

(2) Emulsions A to N were sensitized by gold sensitization, sulfur sensitization and selenium sensitization in the presence of the spectrally-sensitizing dyes described in each spectrally-sensitive layer and sodium thiocyanate, according to the example in JP-A-3-237450.

(3) In preparing the tabular grains, a low-molecular weight gelatin was used according to the example in JP-A-1-158426.

(4) Dislocation lines such as those described in JP-A-3-237450 were found in the tabular grains and the multi-layered normal crystalline grains, when the grains were observed with a high-power electron microscope.

(5) Emulsions A to N contained iridium in an inner part of each grain, added according to the method described in B. H. Carroll, *Photographic Science and Engineering*, 24, 265 (1980).

Compounds used above are mentioned below.

TABLE 1

| | Mean AgI Content (%) | Mean Grain Size (as the diameter of the corresponding circle) (μm) | Fluctuation Coefficient Relative to Grain Size (%) | Ratio of Silver Contents [core/interlayer/shell] (as AgI content %) | Structure and Shape of Grains |
|---|---|---|---|---|---|
| Emulsion A | 4.7 | 0.40 | 10 | [4/1/5] (1/38/1) | three-layer structural cubic grains |
| Emulsion B | 6.0 | 0.49 | 23 | [1/2] (16/1) | two-layer structural tabular grains |
| Emulsion C | 8.4 | 0.65 | 23 | [3/5/2] (0/14/7) | three-layer structural tabular grains |
| Emulsion D | 8.8 | 0.65 | 15 | [12/59/29] (0/12/6) | three-layer structural tabular grains |
| Emulsion E | 4.0 | 0.35 | 25 | — | uniform structural tabular grains |
| Emulsion F | 4.0 | 0.50 | 18 | — | uniform structural tabular grains |
| Emulsion G | 3.5 | 0.55 | 15 | [12/59/29] (0/5/2) | three-layer structural tabular grains |
| Emulsion H | 10.0 | 0.70 | 20 | [12/59/29] (0/13/8) | three-layer structural tabular grains |
| Emulsion I | 9.0 | 0.66 | 19 | [8/59/33] (0/11/8) | three-layer structural tabular grains |
| Emulsion J | 2.5 | 0.46 | 30 | — | uniform structural tabular grains |
| Emulsion K | 13.9 | 1.30 | 25 | [7/13] (34/3) | two-layer structural tabular grains |
| Emulsion L | 2.0 | 0.07 | 15 | — | uniform structural fine grains |
| Emulsion M | 5.2 | 0.80 | 18 | [1/29] (1/7) | two-layer structural tabular grains |
| Emulsion N | 5.4 | 0.71 | 22 | [1/28/18] (0/8/5) | three-layer structural tabular grains |

In Table 1;

(1) Emulsions A to N were sensitized by reduction sensitization with thiourea dioxide and thiosulfonic acid, UV-1
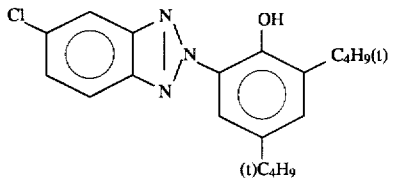
UV-2
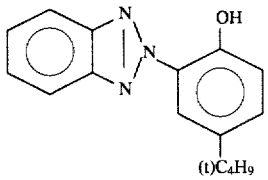
UV-3
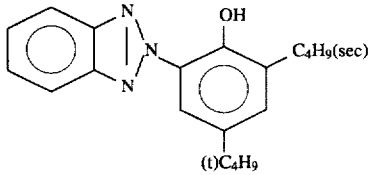
UV-4
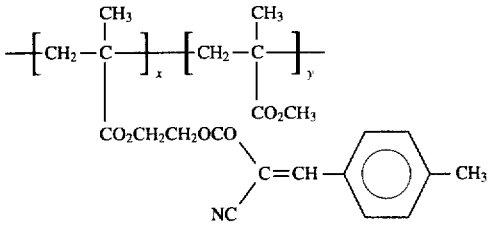
x:y = 70:30 (wt %)
UV-5
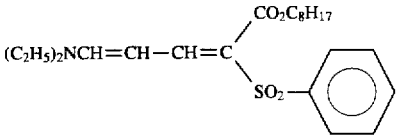
ExF-1
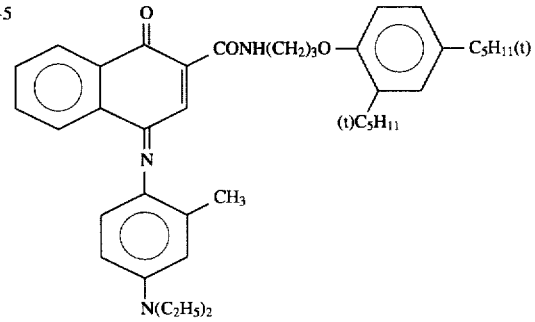
ExF-2
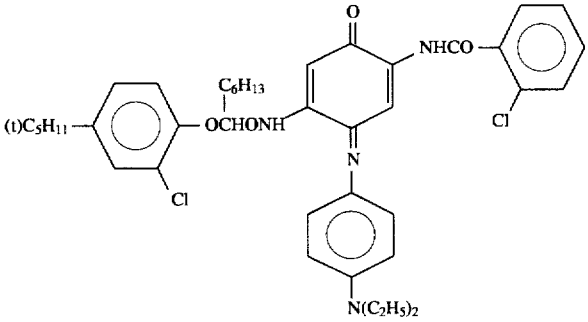
ExF-3
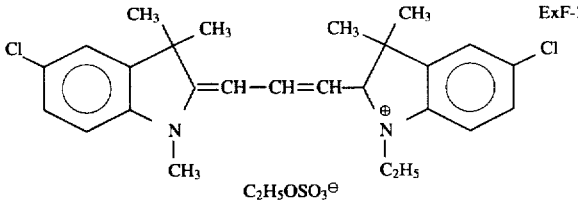
ExC-1
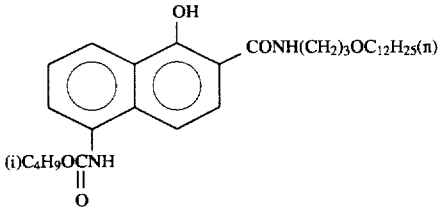

-continued
ExC-2
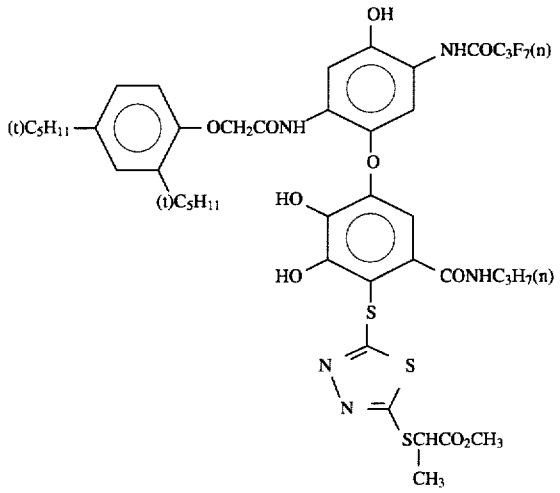
ExC-3
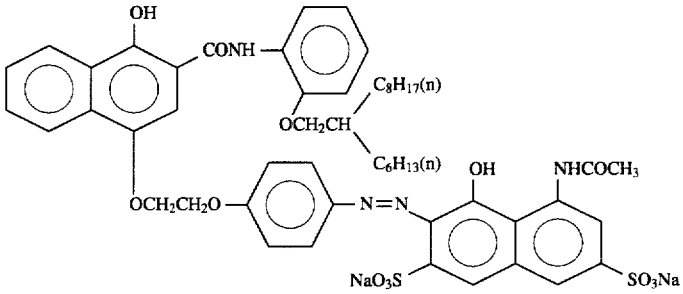
ExC-4
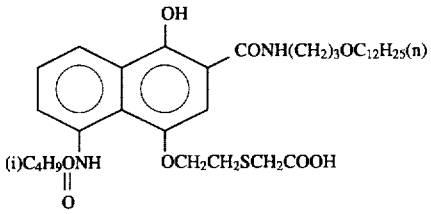
ExC-5
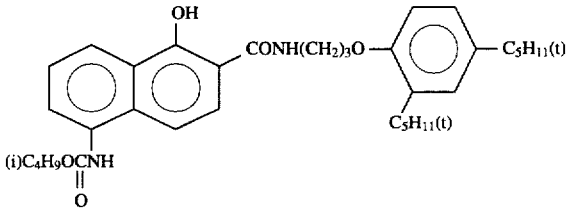
ExC-6
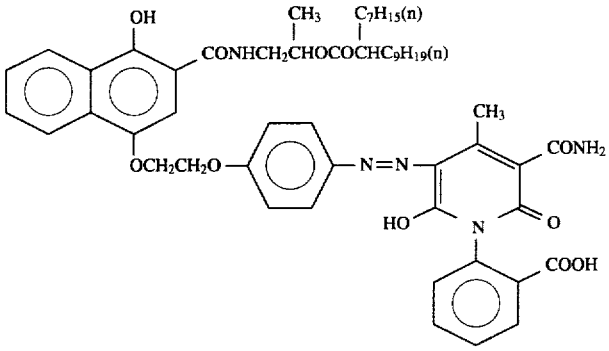

-continued
ExC-7
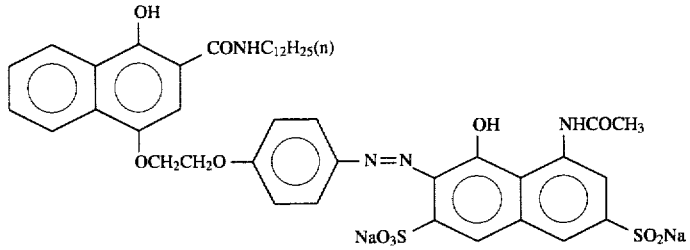
ExC-8
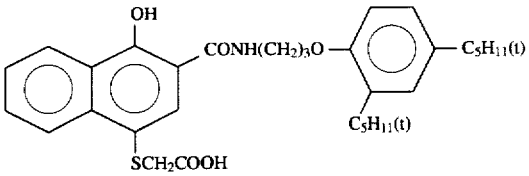
ExC-9
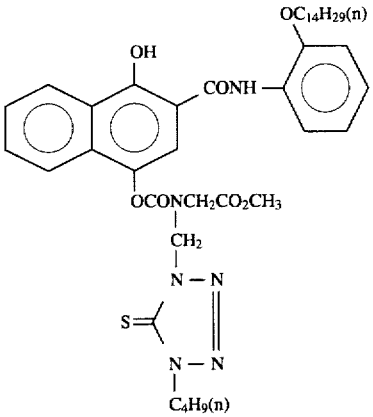
ExM-1
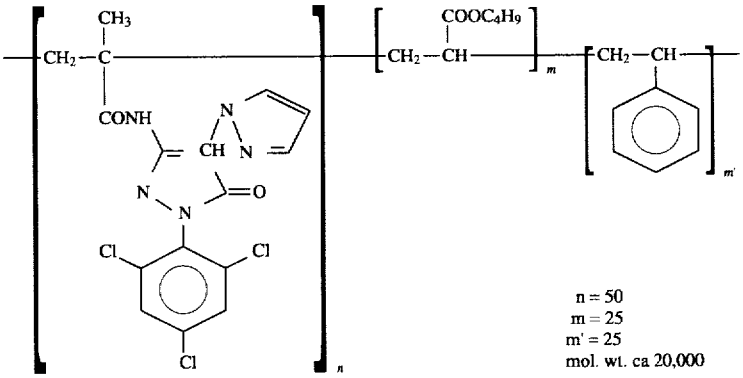
ExM-2
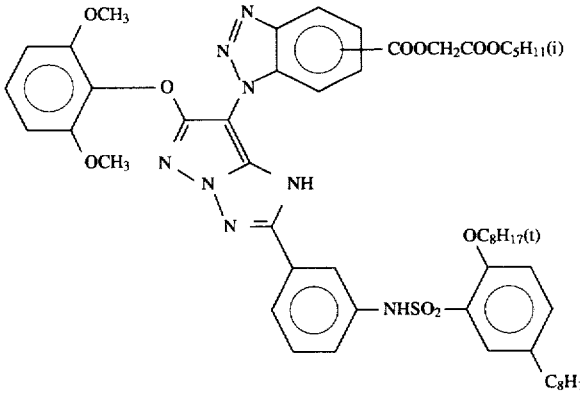

-continued
ExM-3
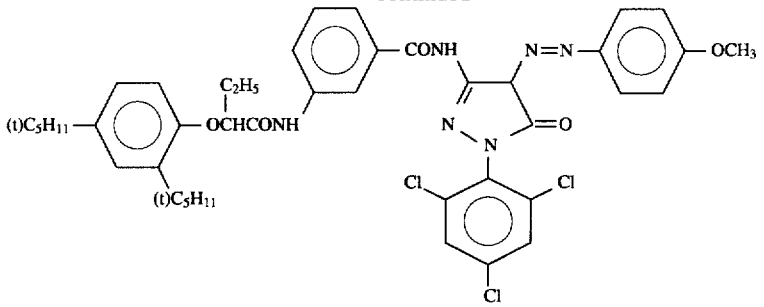
ExM-4
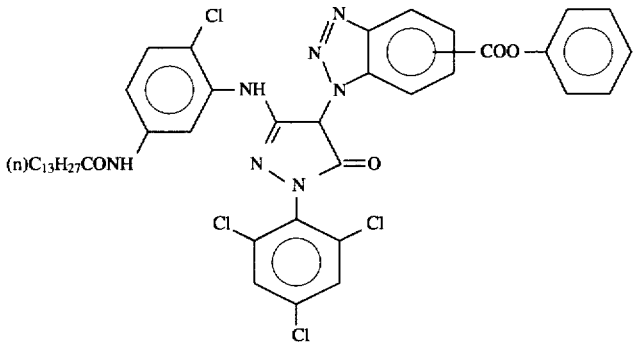
ExM-5
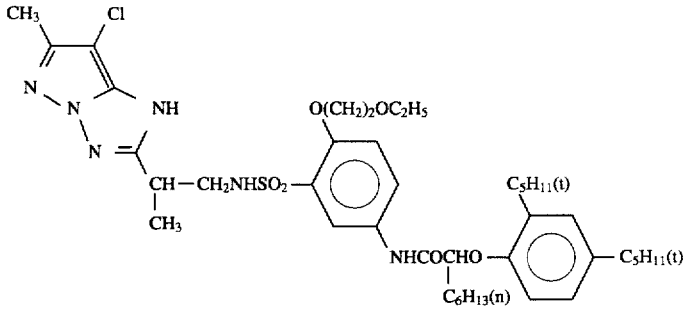
ExM-6
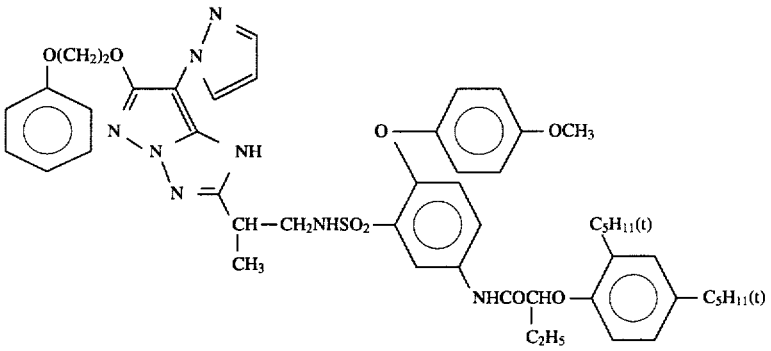
ExM-7
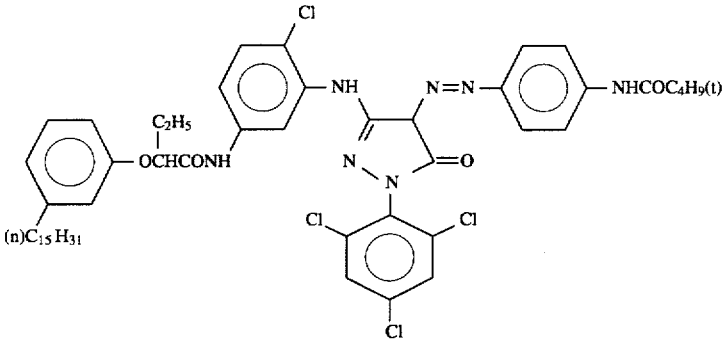

-continued
ExY-1
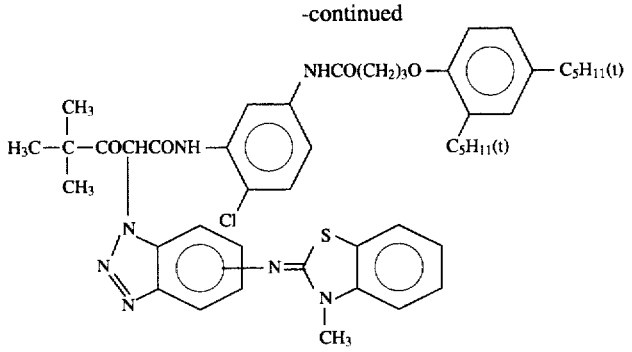
ExY-2
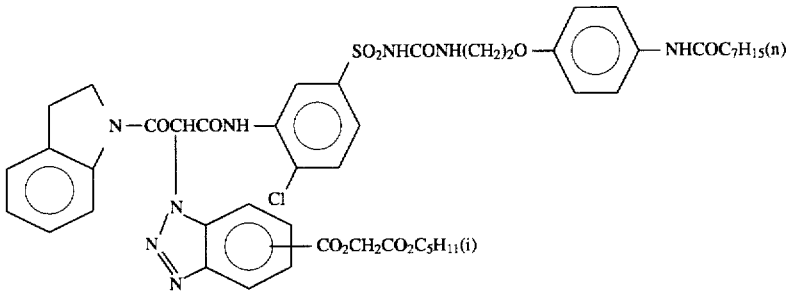
ExY-3
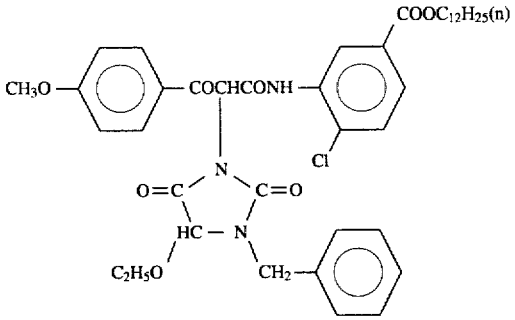
ExY-4
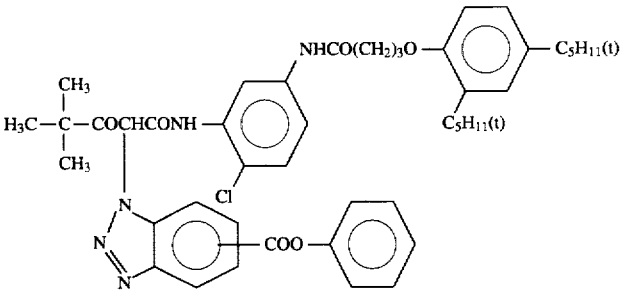
ExY-5
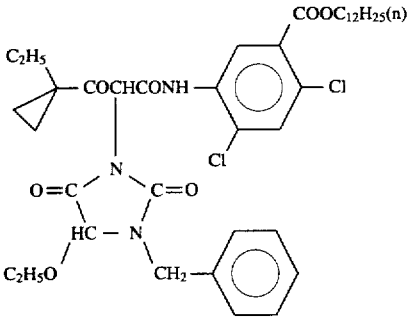
Cpd-1
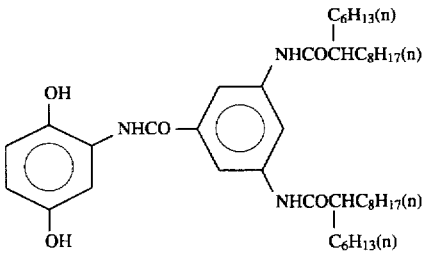

-continued
Cpd-2
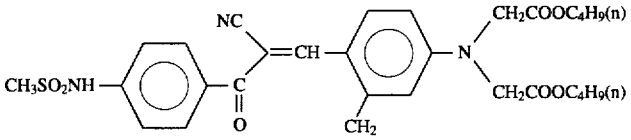
Cpd-3
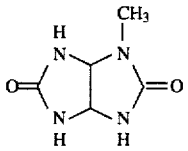
Cpd-4
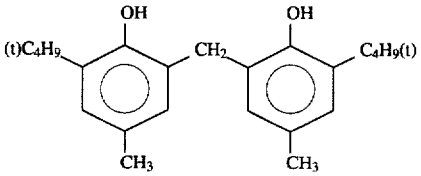
Cpd-5
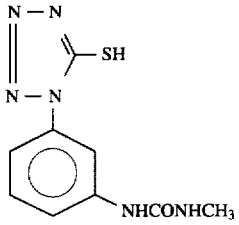
Cpd-6
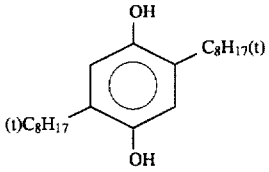
Solv-1
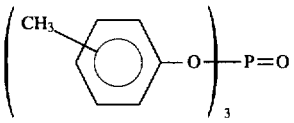
Solv-2
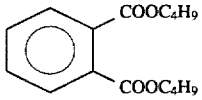
Solv-3
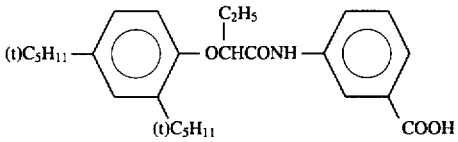
Solv-4
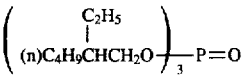
Solv-5
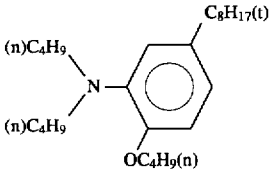
ExS-1
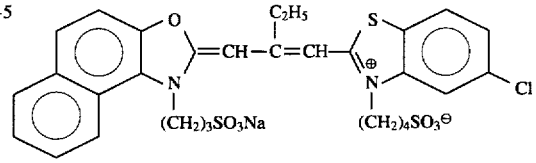
ExS-2
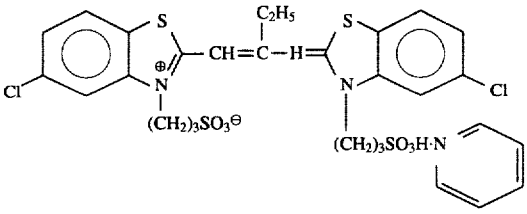
ExS-3
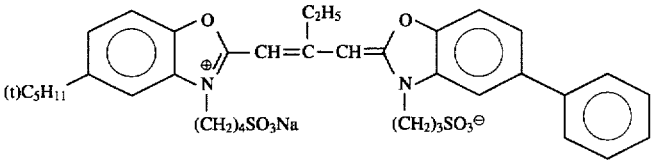
ExS-4
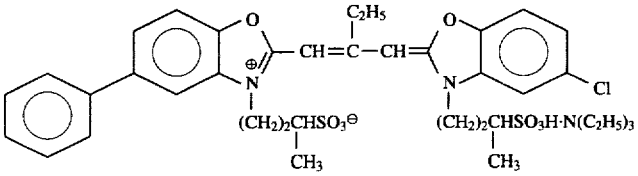

-continued
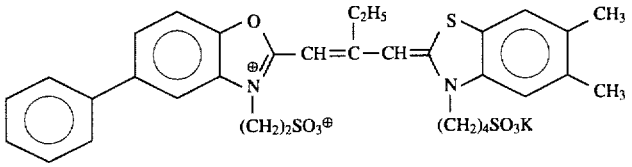
ExS-5
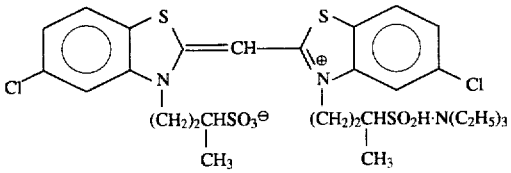
ExS-6
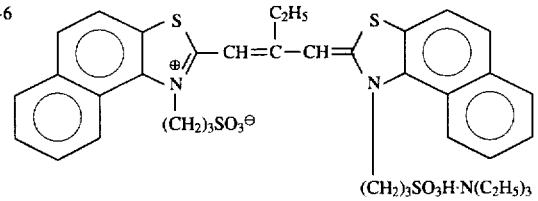
ExS-7
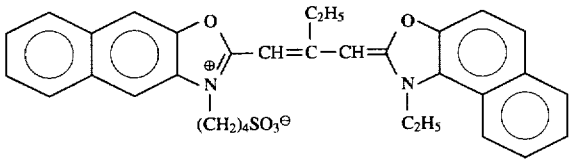
ExS-8
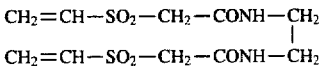
H-1
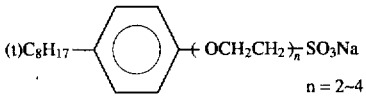
W-1
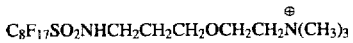
W-2
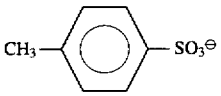
W-3
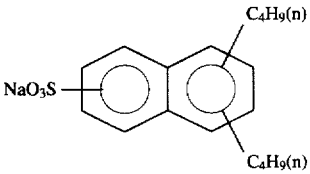
W-4
W-5
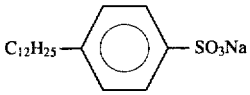
W-6
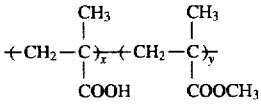
x/y = 10/90
B-1
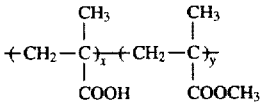
x/y = 40/60
B-2
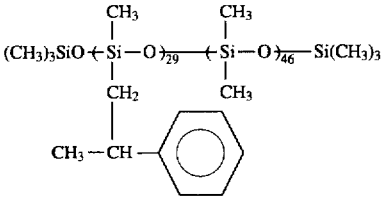
B-3
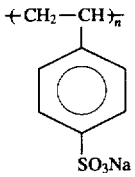
B-4
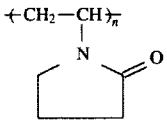
(mol. wt. ca. 10,000)
B-5
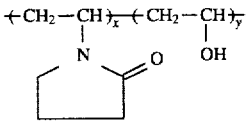
x/y = 70/30
B-6

-continued
F-1
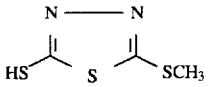
F-2
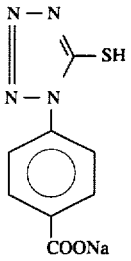
F-3
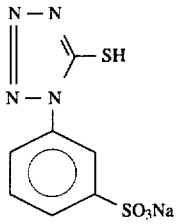
F-4
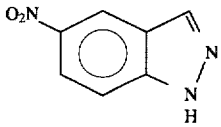
F-5
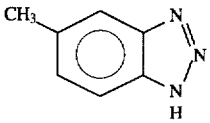
F-6
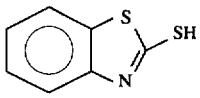
F-7
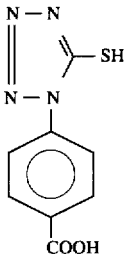
F-8
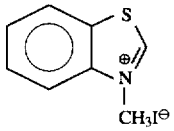
F-9
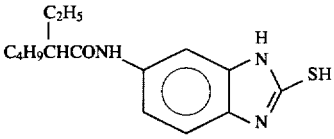
F-10
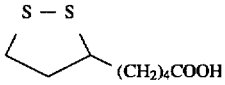
F-11
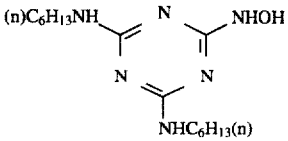
F-12
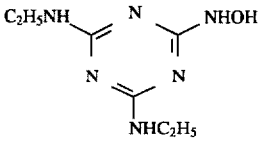
F-13
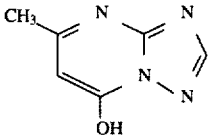
F-14
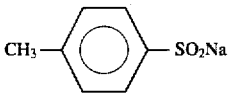
F-15
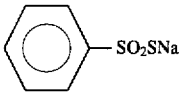
F-16
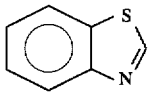
Next, Sample Nos. 102 to 112 were prepared in the same manner as in preparation of Sample No. 101, except that the sensitizing dye, the emulsion and the amount of the couplers in the tenth layer and the yellow colloidal silver in the eleventh layer were changed to those shown in Table 2 below.

TABLE 2

| Sample No. | Sensitizing Dye in 10th Layer (mol per mol of silver) | Emulsion | Amount(*) of Couplers in 10th Layer | Compound in 11th Layer |
|---|---|---|---|---|
| 101 | ExS-3 ($5.6 \times 10^{-4}$) | M | 100 | yellow colloidal silver |
| 102 | ExS-3 ($5.6 \times 10^{-4}$) | M | 97 | D-101 |
| 103 | ExS-3 ($5.6 \times 10^{-4}$) | N | 98 | D-202 |
| 104 | II-1 ($7.3 \times 10^{-4}$) | M | 95 | D-202 |
| 105 | III-3 ($7.6 \times 10^{-4}$) | M | 95 | D-202 |
| 106 | I-1 ($4.2 \times 10^{-4}$)/II-3 ($3.3 \times 10^{-4}$) | M | 95 | yellow colloidal silver |
| 107 | I-1 ($4.2 \times 10^{-4}$)/II-3 ($3.3 \times 10^{-4}$) | M | 91 | D-101 |
| 108 | I-1 ($4.2 \times 10^{-4}$)/II-3 ($3.3 \times 10^{-4}$) | M | 93 | D-202 |
| 109 | ExS-3 ($7.8 \times 10^{-4}$) | N | 97 | yellow colloidal silver |
| 110 | I-1 ($9.5 \times 10^{-4}$) | N | 95 | yellow colloidal silver |
| 111 | I-1 ($9.5 \times 10^{-4}$) | N | 92 | D-101 |
| 112 | II-1 ($5.8 \times 10^{-4}$)/III-3 ($4.0 \times 10^{-4}$) | N | 88 | D-101 |

(*) This means a relative value based on the amount of the couplers in Sample No. 101 of being 100.

To use the dye of the invention in the eleventh layer in place of yellow colloidal silver, the dye was dissolved in a mixed solvent comprising ethyl acetate and tricresyl phosphate and dispersed in an aqueous gelatin solution using a colloid mill, and the resulting dispersion was added to the layer. The amount of the dye added was $3.2 \times 10^{-4}$ mol/m$^2$.

Due to the difference in the sensitizing dye and the emulsion in the tenth layer and the compound in the eleventh layer, the color density of the tenth layer varied in the samples. In order to make the color density of the tenth layer the same in all the samples when exposed to white light, the amount of the couplers in the tenth layer was varied to that indicated in Table 2 above.

These samples were subjected to color development according to the process mentioned below.

| | Processing Time | Temperature |
|---|---|---|
| Color Development | 3 min 15 sec | 38° C. |
| Bleaching | 6 min 30 sec | 38° C. |
| Rinsing | 2 min 10 sec | 24° C. |
| Fixation | 4 min 20 sec | 38° C. |
| Rinsing | 3 min 15 sec | 24° C. |
| Stabilization | 1 min 05 sec | 38° C. |

Compositions of the processing solutions used in these steps are mentioned below.

| | |
|---|---|
| Color Developer: | |
| Diethylenetriaminepentaacetic Acid | 1.0 g |
| 1-Hydrpxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-ethyl-N-β-hydroxyethylamino)-2-methylaniline Sulfate | 4.5 g |
| Water to make | 1.0 liter |
| pH | 10.0 |
| Bleaching Solution: | |
| Ammonium Ethylenediaminetetraacetato/Ferric Complex | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| pH | 6.0 |
| Fixer: | |
| Disodium Ethylenediaminetetraacetate | 1.0 g |
| Sodium Sulfite | 4.0 g |
| Ammonium Thiosulfate Aqueous Solution (70%) | 175.0 ml |
| Sodium Bisulfite | 4.6 g |
| Water to make | 1.0 liter |
| pH | 6.6 |
| Stabilizer: | |
| Formalin (40%) | 2.0 ml |
| Polyoxyethylene P-monononylphenyl Ether (mean polymerization degree: 10) | 0.3 g |
| Water to make | 1.0 liter |

Sample Nos. 101 to 112 were wedgewise exposed to white light and then processed according to the process mentioned above. As a result, the samples were found to have the same sensitivity and gradation.

The granularity of the magenta images of these samples was evaluated by a conventional RMS (Root Mean Square) method. Evaluation of the granularity of RMS method is well known by those skilled in the art, which is described in, for example, "RMS Granularity; Determination of Just Noticeable Difference" in *Photographic Science and Engineering*, Vol. 19, No. 4 (1975), pp. 235 to 238. The aperture used for the measurement in this example was 48 μm.

To evaluate Sample Nos. 101 to 112 with respect to the reproducibility of spectra, the principal wavelength of the reproduced spectra was obtained according to the method described in JP-A-62-160448. The difference ($\lambda_{0-\lambda}$) between the wavelength ($\lambda_0$) of the test light used and the weight-average wavelength ($\lambda$) of the reproduced color was obtained as an average in the range of from 450 nm to 600 nm, according to the following equation, and shown in Table 3 below.

$$\Delta\lambda = \frac{\int_{450}^{600} (\lambda - \lambda_o)d\lambda}{600 - 450}$$

The test light used was composed of a spectral light having a stimulation purity of 0.7 plus white light. The amount for exposure was 0.05 lux.sec and 0.021 lux.sec, in terms of the white light in the test light. The latter shall indicate more distinctively the characteristic of color reproducibility of each sample in under-exposure condition, than the former.

The results obtained are shown in Table 3.

TABLE 3

| Sample No. | RMS of Magenta D = fog + 0.3 (× $10^{-4}$) | RMS of Magenta D = fog + 1.0 (× $10^{-4}$) | Δλ 0.05 lux. sec. | Δλ 0.02 lux.sec. | |
|---|---|---|---|---|---|
| 101 | 16 | 14 | 2.3 | 4.3 | comparative sample |
| 102 | 14 | 13 | 2.1 | 4.0 | comparative sample |
| 103 | 15 | 13 | 2.1 | 4.0 | comparative sample |
| 104 | 12 | 11 | 2.2 | 3.7 | comparative sample |
| 105 | 13 | 11 | 2.1 | 3.5 | comparative sample |
| 106 | 13 | 12 | 2.2 | 3.8 | comparative sample |
| 107 | 10 | 9 | 1.8 | 3.2 | sample of the invention |
| 108 | 9 | 9 | 1.9 | 3.2 | sample of the invention |
| 109 | 14 | 12 | 2.4 | 4.2 | comparative sample |
| 110 | 12 | 10 | 2.1 | 3.6 | comparative sample |
| 111 | 10 | 9 | 2.2 | 3.4 | comparative sample |
| 112 | 7 | 6 | 1.9 | 3.0 | sample of the invention |

As is obvious from the results in Table 3 above, the samples of the present invention had remarkably improved in graininess and much more faithful color reproducibility than the comparative samples.

In particular, it is noted therefrom that the emulsion containing tabular grains having an aspect ratio of 2 or more in an amount of 50% or more of the whole projected area of all the grains therein gave the photographic material sample having the best granularity and color reproducibility.

EXAMPLE 2

Each of Sample Nos. 101 to 112 prepared in Example 1 was worked into a film-with-lens, according to the example described in Japanese Patent Application No. 4-205896. The thus-formed film-with-lens were subjected to picture-taking, and the prints obtained were evaluated. The prints obtained from the samples of the present invention were good, which verified the effect of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising at least one of each of a blue-sensitive silver halide emulsion layer, a green-sensitive silver halide emulsion layer, and a red-sensitive silver halide emulsion layer, and a non-light-sensitive hydrophilic colloid layer on a support, in which said non-light sensitive hydrophilic colloid layer contains a compound of the following formula (I), and said green-sensitive silver halide emulsion layer, which gives an interlayer effect to said red-sensitive silver halide emulsion layer, is located closer to the support than said non-light-sensitive hydrophilic colloid layer and contains a silver halide emulsion which is simultaneously spectrally-sensitized with a compound of each of the following formulae (II) and (III)

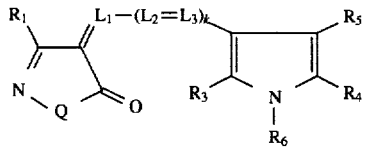

(I)

wherein $R_1$ represents a hydrogen atom, an alkyl group, an alkenyl group, an aryl group, a heterocyclic group, a ureido group, a sulfonamido group, a sulfamoyl group, a sulfonyl group, a sulfinyl group, an alkylthio group, an arylthio group, an oxycarbonyl group, an acyl group, a carbamoyl group, a cyano group, an alkoxy group, an aryloxy group, an amino group or an amido group;

Q represents —O— or —$NR_2$— in which $R_2$ represents a hydrogen atom, an alkyl group, an aryl group or a heterocyclic group;

$R_3$, $R_4$ and $R_5$ each represent a hydrogen atom, an alkyl group or an aryl group, and $R_4$ and $R_5$ may together form a 6-membered ring;

$R_6$ represents a hydrogen atom, an alkyl group, an aryl group or an amino group;

$L_1$, $L_2$ and $L_3$ each represent a methine group; and k represents 0 or 1,

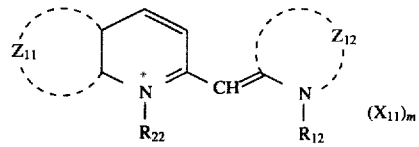

(II)

wherein $R_{11}$ and $R_{12}$ each represent an alkyl group;

$Z_{11}$ represents an atomic group necessary for forming a benzene ring;

$Z_{12}$ represents an atomic group necessary for forming a benzothiazole nucleus or benzoselenazole nucleus;

$X_{11}$ represents a charge-balancing counter ion; and m represents 0 or 1, but m is 0 when the formula forms an internal salt,

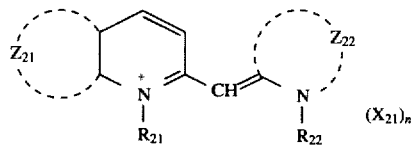

(III)

wherein $R_{21}$, $R_{22}$, $Z_{21}$, $X_{21}$ and n have the same meanings as $R_{11}$, $R_{12}$, $Z_{11}$, $X_{11}$, and m, respectively, in formula (II); and $Z_{22}$ represents an atomic group necessary for forming a benzoxazole nucleus or naphthoxazole.

2. The silver halide color photographic material as claimed in claim 1, wherein the green-sensitive silver halide emulsion layer giving the interlayer effect to the red-sensitive layer contains a silver halide emulsion color-sensitized with at least one compound of the following general formula (IV) and at least one compound of the following general formula (V),

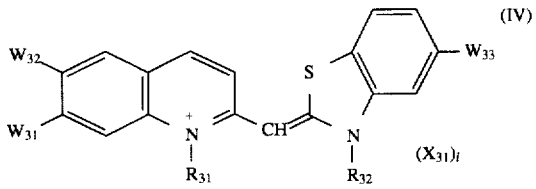

(IV)

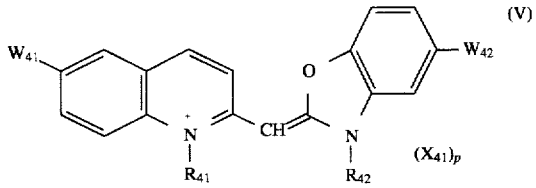

(V)

wherein $R_{31}$, $R_{32}$, $R_{41}$ and $R_{42}$ each represent a sulfoalkyl group or a carboxyalkyl group;

$X_{31}$ and $X_{41}$ each have the same meaning as $X_{11}$ in formula (II); l and p each has the same meaning as m in formula (II); $W_{31}$, $W_{32}$ and $W_{41}$ each represents an alkyl group having 3 or less carbon atoms, a halogen atom, an aryl group or an aryloxy group; and $W_{33}$ and $W_{42}$ each represent a halogen atom or an aryl group.

3. The silver halide color photographic material as claimed in claim 1, wherein the green-sensitive silver halide emulsion layer giving the interlayer effect to the red-sensitive layer contains tabular silver halide grains having an aspect ratio of 2 or more in an amount of 50% or more of the total projected area of all the silver halide grains contained in the layer.

4. The silver halide color photographic material as claimed in claim 1, wherein $R^4$ and $R^5$ in formula (I) together form a 6-membered ring.

5. The silver halide color photographic material as claimed in claim 1, wherein $R^4$ and $R^5$ in formula (I) forms a benzene ring.

6. The silver halide color photographic material as claimed in claim 1, wherein the sensitizing dye of formula (II) or (III) is used in an amount of 10 weight % or more of an amount of a dye in said green-sensitive silver halide emulsion layer.

7. The silver halide color photographic material as claimed in claim 1, wherein the compound of formula (I) is used as a filter dye.

8. The silver halide color photographic material as claimed in claim 1, wherein the compound of formula (I) is used in a yellow filter layer.

9. The silver halide color photographic material as claimed in claim 1, wherein the compound of formula (I) is used in such an amount that an optical density falls within a range of from 0.05 to 3.0.

10. The silver halide color photographic material as claimed in claim 1, wherein the compound of formula (I) is used in such an amount that an optical density falls within a range of from 0.2 to 1.0.

* * * * *